US012653305B2

(12) United States Patent
Alder

(10) Patent No.: US 12,653,305 B2
(45) Date of Patent: Jun. 16, 2026

(54) FURNITURE TRAY TABLE

(71) Applicant: Stander, Inc., Logan, UT (US)

(72) Inventor: Kip Alder, Nibley, UT (US)

(73) Assignee: STANDER, INC., Logan, UT (US)

( * ) Notice: Subject to any disclaimer, the term of this patent is extended or adjusted under 35 U.S.C. 154(b) by 28 days.

(21) Appl. No.: 18/604,829

(22) Filed: Mar. 14, 2024

(65) Prior Publication Data

US 2024/0315440 A1 Sep. 26, 2024

Related U.S. Application Data

(60) Provisional application No. 63/491,906, filed on Mar. 23, 2023.

(51) Int. Cl.

| | |
|---|---|
| ***A47B 23/00*** | (2006.01) |
| ***A47B 9/20*** | (2006.01) |
| ***A47B 13/02*** | (2006.01) |
| ***A47B 13/08*** | (2006.01) |
| ***A47B 23/04*** | (2006.01) |

(52) U.S. Cl.

CPC ..... *A47B 23/046* (2013.01); *A47B 9/20* (2013.01); *A47B 13/02* (2013.01); *A47B 13/081* (2013.01)

(58) Field of Classification Search

CPC ..... A47B 23/046; A47B 23/04; A47B 9/20; A47B 13/02; A47B 13/081; A47B 2200/0031

USPC ..... 108/144.11, 137, 147.19, 147.21, 150, 108/152, 11, 12, 15; 248/279.1, 441.1, 248/447, 458

See application file for complete search history.

(56) References Cited

U.S. PATENT DOCUMENTS

| | | | | |
|---|---|---|---|---|
| 541,339 | A | 6/1895 | Thompson | |
| 640,583 | A | 1/1900 | McAssey et al. | |
| 736,005 | A * | 8/1903 | Peak | |
| 818,917 | A * | 4/1906 | Ruger | |
| 1,347,271 | A | 7/1920 | Hartman | |
| 1,797,847 | A * | 3/1931 | John | A47B 23/02 108/5 |
| 1,862,237 | A | 6/1932 | Thomas | |
| 2,605,155 | A | 7/1952 | Lewis | |
| 2,612,422 | A | 9/1952 | Sarkus | |
| D169,460 | S | 4/1953 | Smith | |

(Continued)

FOREIGN PATENT DOCUMENTS

| | | | | |
|---|---|---|---|---|
| EP | 1645208 A1 * | 4/2006 | ..... | A47B 23/025 |
| FR | 2790651 A1 | 9/2000 | | |

(Continued)

OTHER PUBLICATIONS

Notice of Allowance dated Feb. 23, 2007 for U.S. Appl. No. 10/973,153.

(Continued)

*Primary Examiner* — Janet M Wilkens
(74) *Attorney, Agent, or Firm* — Dorsey & Whitney LLP

(57) ABSTRACT

A furniture table that can include a table surface, a base, a vertical support beam, and a horizontal support arm. The vertical support beam has a first end and a second end, with the first end being coupled to the base. The horizontal support arm has a first end coupled to the table surface and a second end coupled to the second end of the vertical support beam. The horizontal support arm includes an arcuate shaped portion.

18 Claims, 18 Drawing Sheets

(56) References Cited

U.S. PATENT DOCUMENTS

| | | | | |
|---|---|---|---|---|
| 2,709,818 | A | 6/1955 | Freese | |
| 2,991,487 | A | 7/1961 | George | |
| D198,168 | S | 5/1964 | Armstrong | |
| 3,259,923 | A | 7/1966 | Batteram | |
| 3,564,627 | A | 2/1971 | Allard et al. | |
| 3,866,251 | A | 2/1975 | Pounds | |
| 4,077,333 | A | 3/1978 | Ballas | |
| D261,837 | S | 11/1981 | Sonder et al. | |
| 4,672,898 | A | 6/1987 | Davidson | |
| D292,150 | S | 10/1987 | Restin et al. | |
| D292,956 | S | 12/1987 | Inoue et al. | |
| 4,715,573 | A | 12/1987 | Liegel | |
| 4,724,555 | A | 2/1988 | Poehner et al. | |
| 4,724,559 | A | 2/1988 | Bly et al. | |
| D295,348 | S | 4/1988 | Muller | |
| D296,851 | S | 7/1988 | Kelley | |
| 4,801,120 | A * | 1/1989 | Gregoire | A47B 23/04 248/458 |
| 4,826,151 | A * | 5/1989 | Nuredin | A63B 21/4034 482/141 |
| 4,932,090 | A | 6/1990 | Johansson | |
| 5,037,162 | A * | 8/1991 | Ransom | A47B 23/04 312/236 |
| 5,038,434 | A | 8/1991 | Navarrette | |
| D323,560 | S | 1/1992 | Boyce et al. | |
| 5,337,430 | A | 8/1994 | Schlein | |
| 5,359,741 | A | 11/1994 | Lang | |
| D353,926 | S | 12/1994 | Aguilar et al. | |
| 5,374,019 | A | 12/1994 | Fischer | |
| 5,400,450 | A | 3/1995 | Leoutsakos | |
| 5,425,148 | A | 6/1995 | Ashcraft et al. | |
| 5,448,791 | A | 9/1995 | Brown | |
| D363,492 | S | 10/1995 | Brussing | |
| 5,507,044 | A | 4/1996 | Williamson et al. | |
| D375,641 | S | 11/1996 | Dhanapal et al. | |
| 5,586,352 | A | 12/1996 | OBrien et al. | |
| 5,746,334 | A | 5/1998 | Brandenberg | |
| 5,787,530 | A | 8/1998 | Brix | |
| 5,806,548 | A | 9/1998 | Goldstein et al. | |
| 5,881,406 | A | 3/1999 | Cobb | |
| D418,997 | S | 1/2000 | Tedaldi et al. | |
| D428,732 | S | 8/2000 | Roddan | |
| 6,138,301 | A | 10/2000 | Battiston | |
| D438,408 | S | 3/2001 | Hannappel | |
| 6,224,026 | B1 | 5/2001 | Dubois | |
| 6,240,856 | B1 | 6/2001 | Paskey et al. | |
| D446,045 | S | 8/2001 | Hunt et al. | |
| 6,311,942 | B1 | 11/2001 | Rotter et al. | |
| 6,401,280 | B1 | 6/2002 | Baker | |
| D467,754 | S | 12/2002 | Chen | |
| 6,519,794 | B1 | 2/2003 | Aarestad et al. | |
| 6,615,744 | B1 | 9/2003 | Eckstein et al. | |
| 6,688,634 | B2 | 2/2004 | Noffsinger | |
| 6,742,755 | B2 | 6/2004 | Pryor | |
| D501,336 | S | 2/2005 | Lin | |
| 7,017,988 | B2 | 3/2006 | Tornero et al. | |
| D543,722 | S | 6/2007 | Cookson | |
| D548,496 | S | 8/2007 | Samtani | |
| D581,704 | S | 12/2008 | Hwang | |
| D588,829 | S | 3/2009 | Rheault et al. | |
| 7,540,243 | B2 | 6/2009 | George et al. | |
| 7,584,973 | B2 | 9/2009 | Brager | |
| 7,631,604 | B2 | 12/2009 | Huang | |
| D612,169 | S | 3/2010 | Chang | |
| D619,264 | S | 7/2010 | Livengood et al. | |
| D620,276 | S | 7/2010 | Miller | |
| D627,178 | S | 11/2010 | Adams et al. | |
| D632,796 | S | 2/2011 | Ross et al. | |
| D638,637 | S | 5/2011 | Foley | |
| D640,486 | S | 6/2011 | Saelid | |
| 8,100,061 | B2 | 1/2012 | Hookway et al. | |
| D656,760 | S | 4/2012 | Fox | |
| D683,557 | S | 6/2013 | Block | |
| D687,656 | S | 8/2013 | Copeland | |
| D692,702 | S | 11/2013 | Miller | |
| D714,073 | S | 9/2014 | Pittman | |
| 8,960,104 | B2 * | 2/2015 | Copeland | A47B 9/00 108/5 |
| 9,140,406 | B2 | 9/2015 | Simon | |
| D774,810 | S | 12/2016 | Biddle et al. | |
| 9,757,024 | B2 * | 9/2017 | Corrigan | A61B 3/0083 |
| 10,897,989 | B1 * | 1/2021 | Mink | A47B 13/088 |
| D1,070,402 | S | 4/2025 | Alder | |
| 2002/0096091 | A1 | 7/2002 | Cloud | |
| 2005/0132935 | A1 | 6/2005 | Lahmann et al. | |
| 2006/0180054 | A1 | 8/2006 | George et al. | |
| 2007/0234934 | A1 | 10/2007 | Branch et al. | |
| 2008/0073946 | A1 | 3/2008 | Maione | |
| 2008/0121150 | A1 | 5/2008 | Picchio | |
| 2009/0307843 | A1 | 12/2009 | Hookway et al. | |
| 2013/0284077 | A1 | 10/2013 | Copeland et al. | |
| 2014/0225402 | A1 * | 8/2014 | Dehli | A47C 7/723 297/173 |
| 2021/0045536 | A1 | 2/2021 | Chen | |
| 2024/0130519 | A1 | 4/2024 | Simon | |
| 2024/0315440 | A1 | 9/2024 | Alder | |

FOREIGN PATENT DOCUMENTS

| | | | |
|---|---|---|---|
| JP | 2000245540 | A | 9/2000 |
| JP | 2002045268 | A | 2/2002 |

OTHER PUBLICATIONS

Notice of Allowance dated Mar. 22, 2010 for U.S. Appl. No. 29/335,369.

Notice of Allowance dated Jun. 19, 2013 for U.S. Appl. No. 29/427,431.

Notice of Allowance dated Sep. 6, 2017 for U.S. Appl. No. 29/563,993.

Notice of Allowance dated Dec. 2, 2005 for U.S. Appl. No. 10/764,903.

Office Action dated Jan. 27, 2003 for U.S. Appl. No. 09/150,268. Unavailable.

Office Action dated Mar. 24, 2005 for U.S. Appl. No. 10/973,153.

Office Action dated Mar. 24, 2005 for U.S. Appl. No. 10/764,903.

Office Action dated May 24, 2017 for U.S. Appl. No. 29/563,993.

Office Action dated Aug. 15, 2006 for U.S. Appl. No. 10/973,153.

Office Action dated Aug. 20, 2003 for U.S. Appl. No. 09/150,268. Unavailable.

Office Action dated Sep. 12, 2005 for U.S. Appl. No. 10/973,153.

Office Action dated Sep. 21, 2004 for U.S. Appl. No. 10/764,903.

Omni Tray: Announced Aug. 10, 2016 (online), site visited May 4, 2017. Available from internet URL: http://stander.com/product/69-omni-tray.

Standers, Inc., Empowering the World to Its Feet, Couch Cane Web advertisement, http://web.archive.org/web/20050407230811/stander.com/web/couchcane.htm, Oct. 2006.

Notice of Allowance dated Jun. 23, 2025 issued in U.S. Appl. No. 29/932,839.

Stander Wonder Tray Assembly Instructions. YouTube video published 9 months ago [Aug. 5, 2024] by Stander Mobility. URL: https://www.youtube.com/watch?v=UlmrWNk-szY. Viewed online May 14, 2025. (Year: 2024).

Stander Wonder Tray., Walmart. Available at URL: https://www.walmart.com/ip/Able-Life-Swivel-TV-Tray-Table-Adjustable-Laptop-Desk-and-Dinner-Tray/52025049. (Older variation) Photo reviewed May 24, 2023. Viewed online May 14, 2025. (Year: 2023).

Stander Wonder TV Tray, Large, Maple. Stander Store. Amazon first available Jul. 23, 2024. Available at URL: https://amzn.asia/d/bPCzXoR. Viewed online May 14, 2025. (Year: 2024).

* cited by examiner

FURNITURE TRAY TABLE

RELATED APPLICATIONS

This application claims priority to U.S. Provisional Application No. 63/491,906, filed on Mar. 23, 2023 and titled "FURNITURE TRAY TABLE," which is hereby incorporated by reference in its entirety.

TECHNICAL FIELD

The present disclosure relates generally to tray tables. More specifically, the present disclosure relates to tray tables to be utilized in proximity of furniture.

BRIEF DESCRIPTION OF THE DRAWINGS

The embodiments disclosed herein will become more fully apparent from the following description and appended claims, taken in conjunction with the accompanying drawings. The drawings depict only typical embodiments, which embodiments will be described with additional specificity and detail in connection with the drawings in which:

DETAILED DESCRIPTION

It will be readily understood that the components of the embodiments as generally described and illustrated in the Figures herein could be arranged and designed in a wide variety of different configurations. Thus, the following more detailed description of various embodiments, as represented in the Figures, is not intended to limit the scope of the disclosure, but is merely representative of various embodiments While the various aspects of the embodiments are presented in drawings, the drawings are not necessarily drawn to scale unless specifically indicated.

The phrase "coupled to" is broad enough to refer to any suitable coupling or other form of interaction between two or more entities, including mechanical. Two components may be coupled to each other even though they are not in direct contact with each other.

Figure 1:
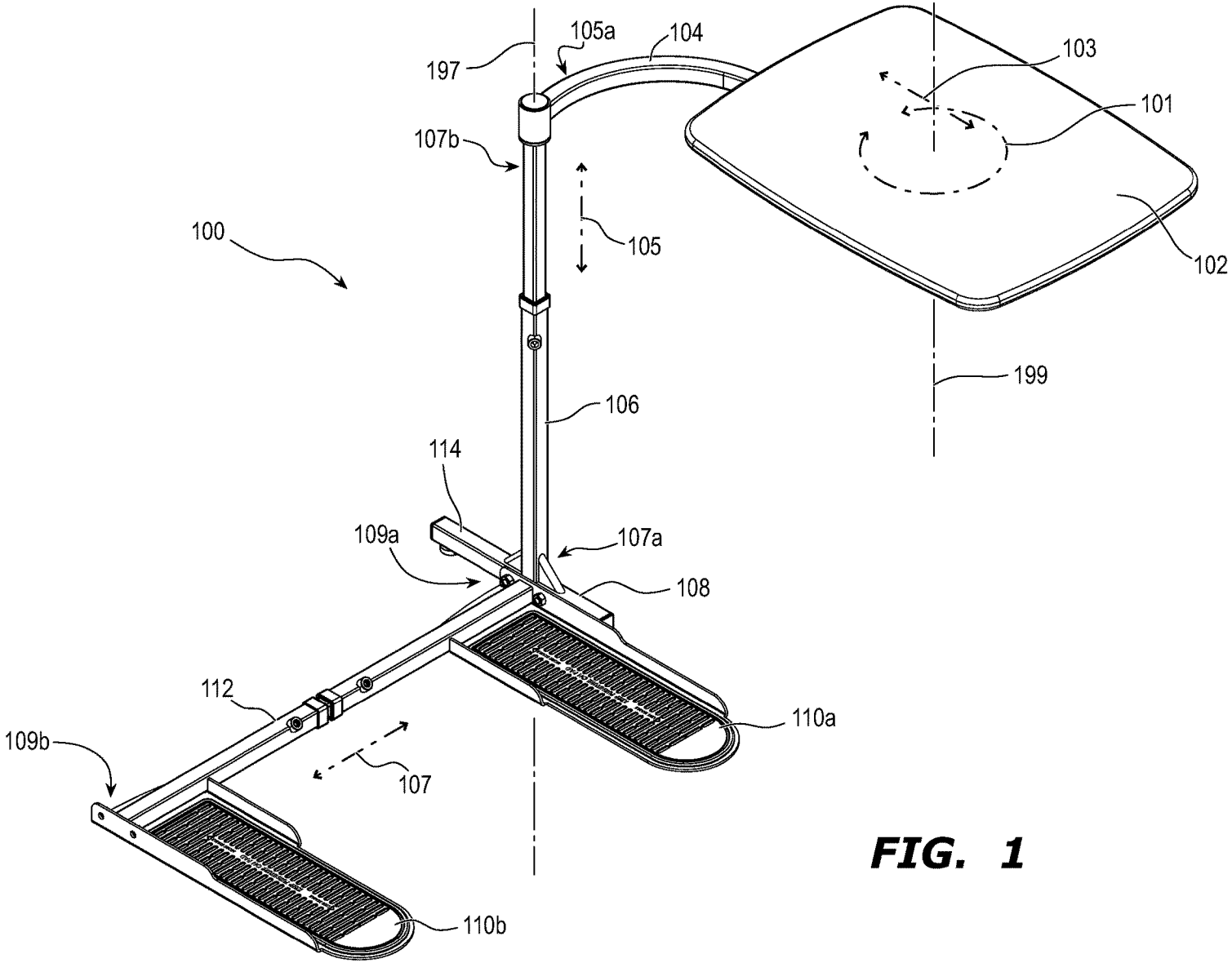
FIG. 1 is a perspective view of a tray table in a left-position configuration, according to one embodiment of the present disclosure.

FIG. 1 is a perspective view of a tray table 100 in a left-position configuration, according to one embodiment of the present disclosure. In some embodiments, the tray table 100 may be a furniture table, a rotatable tray table, a portable tray table, or the like. The tray table 100 includes a table surface 102, a horizontal support arm 104, a vertical support beam 106, and a base 108. The tray table 100 may be designed to be used as a portable table to provide a user with a surface on which to set various items, such as food, drinks, electronic devices, personal items, or the like. The tray table 100 may be designed to be stabilized and/or held upright by being positioned under furniture, for example, the legs or base of chairs, couches, beds, etc. The tray table 100 may be positioned to be on either a right side or a left side of a unit of furniture to accommodate right- or left-handedness of the user, furniture layout within a particular space, furniture configuration, and the like. As depicted in FIG. 1, the tray table is in the left-position configuration, meaning that the tray table 100 is configured to be positioned on a left side of a unit of furniture (e.g., from the perspective of a user sitting on the unit of furniture).

The table surface 102 may be a substantially planar surface on which the user may place various items, such as foods, drinks, electronic devices, and the like. A surface area of the table surface 102 may be such that the user has sufficient space to place the various items, but not sufficiently large to be cumbersome. For example, the surface area of the table surface 102 may be less than a surface area of a standard dining table or office desk. The table surface 102 may generally be configured to be horizontal and parallel to the ground, such that the various items placed on it are stable. However, in some embodiments, the table surface 102 may be configured to be tilted such that certain various items (e.g., some electronic devices, books, etc.) may be angled towards the user without the user needing to support the certain various items manually.

In some embodiments, the table surface 102 may include features, such as grooves, bevels, borders, ridges, cup holders, drawers, etc. that may be included depending on needs and requirements of the user. Furthermore, the surface of the table surface 102 may be smooth or rough (e.g., to provide friction with the various items).

The table surface 102 is mechanically coupled to a first end of the horizontal support arm 104, which may also be referred to as an upper horizontal support arm 104. The mechanical coupling between the table surface 102 and the horizontal support arm 104 may allow for rotation of the table surface 102 about the mechanical coupling and within its own plane, as indicated by arrow 101. Specifically, the table surface 102 is rotatable about a transverse axis 199 of the horizontal support arm 104, the transverse axis 199 being parallel to the vertical support beam 106 and a longitudinal axis 198 of the vertical support beam 106.

A second end of the horizontal support arm 104 is mechanically coupled to the vertical support beam 106. The horizontal support arm 104 may be rotatable about the longitudinal axis 197 of the vertical support beam 106 to allow the table surface 102 to be moved between a first position (as depicted FIGS. 15, 17, 19, 20, and 22), in which the table surface 102 is positioned above the unit of furniture (and the user, if present) and a second position (as depicted in FIGS. 16, 18, and 21), in which the table surface 102 is positioned towards the side of the unit of furniture.

In some embodiments, the horizontal support arm 104 is a horizontal curved support arm. In certain embodiments, the horizontal support arm 104 can be described as comprising an arcuate shaped portion. The horizontal support arm 104 may be curved or have a curved profile within a plane perpendicular or substantially perpendicular to the vertical support beam 106 (or in other words, in a plane parallel or substantially parallel to the table surface 102). The curve may include one or more of an arc of a circular curve, an arc of an elliptical curve, or one or more arcs of a compound curve. In some embodiments, the curve may include a combination of one or more of arcs of a circle, an ellipse, or an arbitrary compound curve. In some embodiments, rather than being curved, the horizontal support arm 104 may be angled within the plane substantially perpendicular to the vertical support beam 106.

The curved profile of the horizontal support arm 104 may allow the table surface 102 to be moved between the first position and the second position while preventing the horizontal support arm 104 from colliding with features, such as armrests and the like, of the unit of furniture (as compared to a horizontal support arm having a straight profile). In general, the curvature of the horizontal support arm 104 is convex with respect to its direction of rotation required to move the table surface 102 about the vertical support beam 106 from the first position to the second position, and thus is opposite depending on whether the tray table 100 is positioned to the left or to the right of the unit of furniture.

As depicted in FIG. 1, the tray table 100 may be configured to be positioned on a left side of a unit of furniture, such that rotating the horizontal support arm 104 about the vertical support beam 106 counterclockwise (as viewed from above the table surface 102), moves the table surface 102 away from the user (e.g., toward the second position, allowing the user to sit onto or stand up from the unit of furniture), while rotating the horizontal support arm 104 about the vertical support beam 106 clockwise moves the table surface 102 towards the user (e.g., toward the first position, so as to be position substantially above legs of the user). It is worth noting that FIGS. 2-7 described below correspond to the configuration of FIG. 1, wherein the tray table 100 is disposed on the left side of the unit of furniture.

In some embodiments, the horizontal support arm 104 may include two or more sections that are mechanically coupled together to allow a distance between the vertical support beam 106 and a center of the table surface 102 to be adjusted, for example, to accommodate a various different types of furniture (such as couches, sofas, armchairs, office chairs, etc.), as indicated by arrow 103.

The vertical support beam 106 is coupled between the horizontal support arm 104 and the base 108. In other words, a first end 107*a* of the vertical support beam 106 is mechanically couplable to the base 108 and a second end 107*b* of the vertical support beam 106 is couplable to the second end of the horizontal support arm 104. A length (or height) of the vertical support beam 106 may be adjustable in order to adjust a height of the tray table 100, as indicated by arrow 105.

The base 108 of the tray table 100 is coupled to the first end 107*a* of the vertical support beam 106 and assists to maintain the tray table 100 in an upright and stable position. The base 108 includes a first platform 110*a* and a second platform 110*b* which are coupled by a lower horizontal support beam 112, which may also be referred to as a floor horizontal support beam 112. In particular, the first platform 110*a* may be coupled to a first end 109*a* of the lower horizontal support beam 112 and the second platform 110*b* may be coupled to a second end 109*b* of the lower horizontal support beam 112. The first and second platforms 110*a-b* protrude or extend perpendicularly away from the lower horizontal support beam 112 and are configured to be disposed below the unit of furniture in order to secure the tray table 100 in the upright and stable position. For example, each of the first and second platforms 110*a-b* may be secured underneath a respective leg of a chair or stool with three or more legs. Alternatively, each of the platforms 110*a-b* may be secured underneath a continuous base of the unit of furniture.

A length of the lower horizontal support beam 112 may be adjustable to adjust a distance between the first and second platforms 110*a* and 110*b*, as indicated by arrow 107. The distance between the first and second platforms 110*a* and 110*b* may be adjusted to accommodate the unit of furniture (e.g., to adjust for varying distances between furniture legs for different units of furniture).

In some embodiments, the first and second platforms 110*a-b* have a flat profile such that when disposed beneath furniture, only a negligible height is added. In some embodiments, the distance by which the first and second platforms 110*a-b* extend from the lower horizontal support beam 112 is adjustable to accommodate various types of furniture (for example, the legs of some units of furniture are disposed further from the edge than for others). As such, at least one dimension of the base 108 is adjustable.

In some embodiments, the base 108 further includes an opposing bar 114. The opposing bar 114 may be coupled to the first end 109*a* of the lower horizontal support beam 112, the first platform 110*a*, and the first end 107*a* of the vertical support beam 106. In some embodiments, each of the opposing bar 114, the lower horizontal support beam 112, and the vertical support beam 106 are mutually perpendicular. The opposing bar 114 may provide an additional counterbalance to stabilize the tray table 100. In some embodiments, the opposing bar 114 allows the tray table 100 to stand upright even when the first and second platforms 110*a-b* are not disposed below furniture. For example, the platform 110*a*, the platform 110*b*, and the opposing bar 114 may be configured as a triangular stand of the tray table 100, allowing it to stand upright without being supported by furniture.

Figure 2:
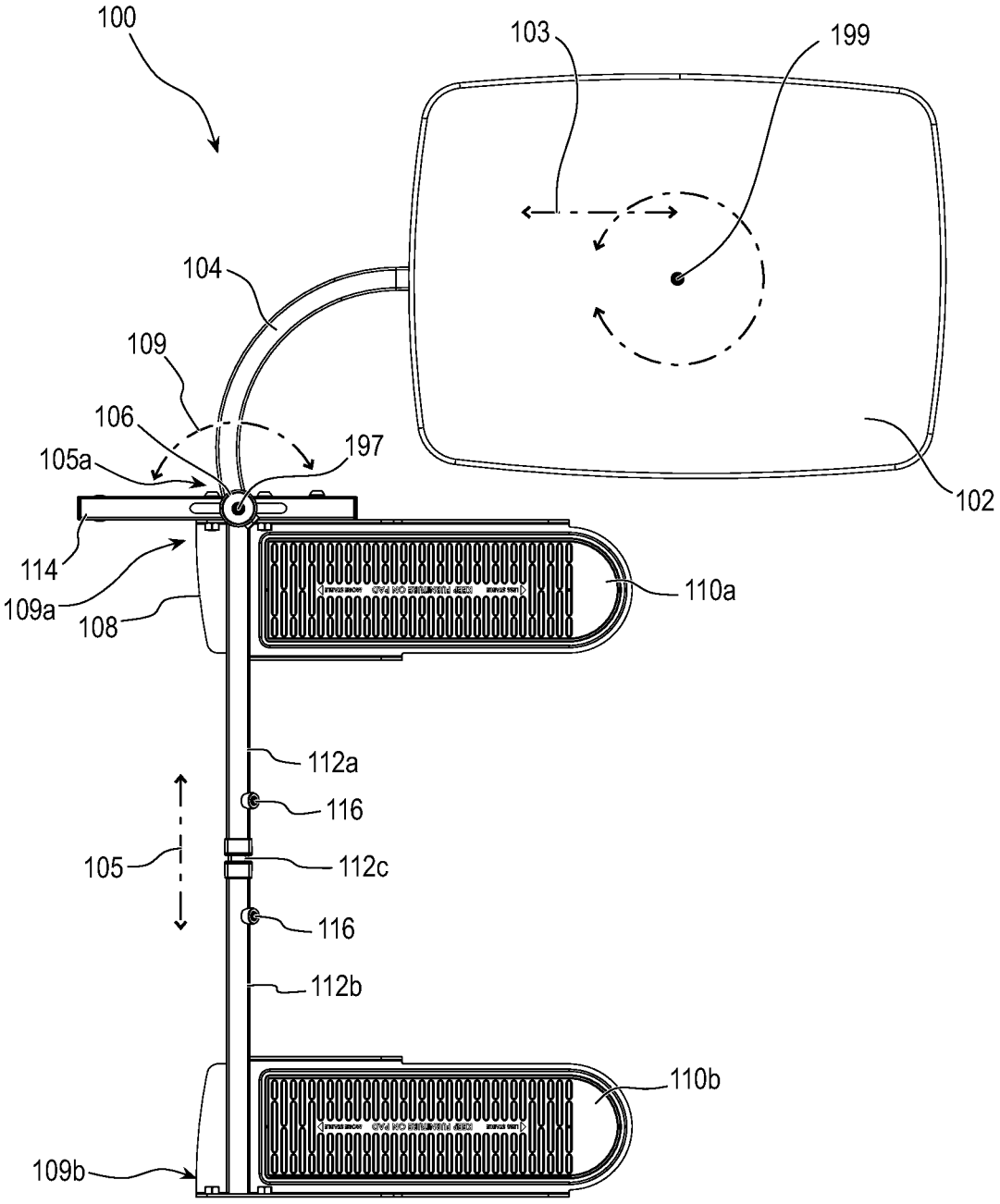
FIG. 2 is a top view of the tray table of FIG. 1.

FIG. 2 is a top view of the tray table 100. As described with respect to FIG. 1, the tray table 100 includes the table surface 102, the vertical support beam 106 (also referred to as a first support beam), and the horizontal support arm 104 (also referred to as a second support beam). As depicted, and as described with respect to FIG. 1, the horizontal support arm 104 is coupled between the vertical support beam 106 and the table surface 102, which provides the tray table 100 with two axes of rotation, the transverse axis 199 and the longitudinal axis 197. The horizontal support arm 104 forms a curve and a first end 105*a* of the horizontal support arm 104 is coupled to the second end 107*b* of the vertical support beam 106. At the point of coupling, the horizontal support arm 104 is rotatable about the longitudinal axis 197 of the vertical support beam 106. A second end 105*b* of the horizontal support arm 104 is coupled to the table surface 102 (see FIG. 3). The table surface is rotatable about the second end of the horizontal support arm 104 about the transverse axis 199 and within a plane parallel to the table surface 102. The transverse axis 199 is parallel to the longitudinal axis 197 and intersects the horizontal support arm 104.

The tray table 100 further includes the lower horizontal support beam 112 (also referred to as a third support beam). A first end of the lower horizontal support beam 112 is coupled to a second end (opposite the first end) of the vertical support beam 106. The lower horizontal support beam 112 is perpendicular to the vertical support beam 106 and lies in a plane which is parallel to a plane in which the horizontal support arm 104 lies. The tray table 100 includes the first and second platforms 110*a-b* (also referred to as protrusions, feet, extensions, or the like) and the opposing bar 114 (also referred to as a protrusion, foot, extension, or the like). The first platform 110*a*, the vertical support beam 106, and the lower horizontal support beam 112 are mutually perpendicular.

The first platform 110*a* and the opposing bar 114 are coupled to the first end 109*a* of the lower horizontal support beam 112 and the second platform 110*b* is coupled to a second end 109*b* of the lower horizontal support beam 112. The first and second platforms 110*a-b* extend away from the lower horizontal support beam 112 in a first direction which is towards the unit of furniture. The opposing bar 114 extends away from the lower horizontal support beam 112 in a second direction, opposite the first direction, that is away from the unit of furniture.

The first and second platforms 110*a-b* may be configured to be placed under the legs or base of the unit of furniture to stabilize the vertical support beam 106 in an upright position. In some embodiments, the first and second platforms 110*a-b* may be textured, covered in rubber, grit, include a border of lips or bevels, etc., to prevent the tray table 100 from sliding out from under the legs or base of the unit of furniture.

The length of the lower horizontal support beam 112 is adjustable to accommodate various units of furniture. In some embodiments, the lower horizontal support beam 112 may include a first section 112*a*, a second section 112*b*, and a third section 112*c*, allowing the length to be adjustable. For example, a portion of varying length of the third section 112*c* may be configured to be disposed within each of the first section 112*a* and the second section 112*b* to allow for a distance between the first section 112*a* and the second section 112*b* to be adjustable. In other embodiments, varying lengths of the first section 112*a* and the second section 112*b* may be disposed within the third section 112*c*. In other embodiments, there may be two or more portions that are telescoping. In some embodiments, the lower horizontal support beam 112 may include the first section 112*a* and the second section 112*b* with the second section 112*b* being disposed within the first section 112*a* and the second section 112*b* may be able to telescope relative to the first section 112*a*. The adjustable length of the lower horizontal support beam 112 may be set by one or more fasteners 116, which may be screws, pegs, spring-loaded fasteners, or any other suitable type of fastener.

Figure 3:
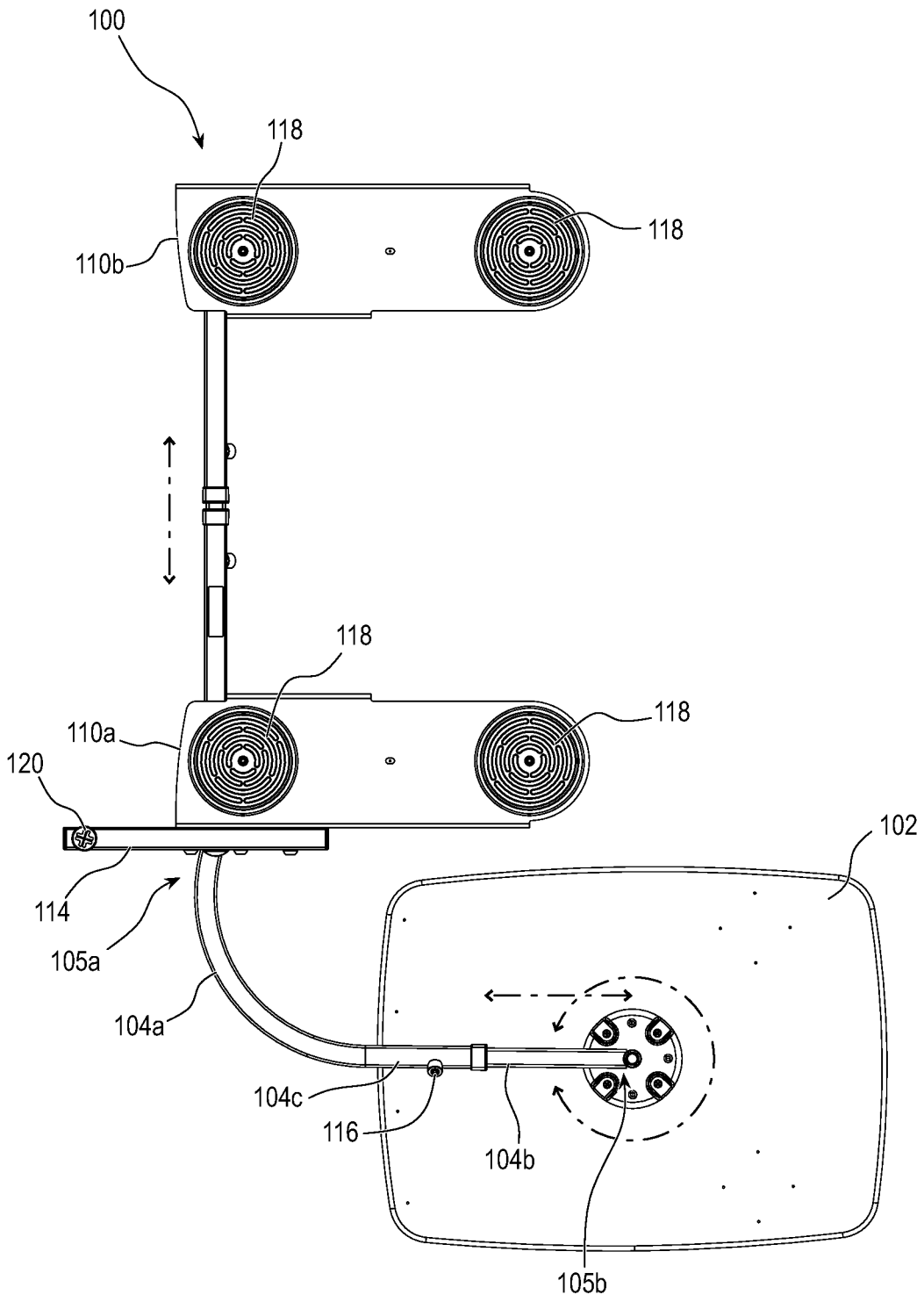
FIG. 3 is a bottom view of the tray table of FIG. 1.

FIG. 3 is a bottom view of the tray table 100. The first and second platforms 110*a-b* may include pads 118 underneath to contact the ground to prevent the tray table 100 from sliding out from under the legs or base of the unit of furniture or from scratching surfaces of the ground. Similarly, the opposing bar 114 may include a pad 120 to prevent the tray table 100 from sliding out from under the legs or base of the unit of furniture or from scratching surfaces of the ground. The pads 118 or 120 may be textured, covered in rubber, grit, felt, fabric, or the like.

The horizontal support arm 104 is coupled between the table surface 102 and the vertical support beam 106. Specifically, the first end 105*a* of the horizontal support arm 104 is coupled to the second end 107*b* of the vertical support beam 106 and a second end 105*b* of the horizontal support arm 104 is coupled to the table surface 102. In one embodiment, the second end 105*b* of the horizontal support arm 104 is coupled to the table surface 102 by a plate 122. The plate 122 may be extended such that a torque about the point of coupling between the table surface 102 and the horizontal support arm 104 is reduced, for example, when items are placed off-center on the table surface 102. The plate 122 may have an elliptical, rectangular, H-shaped, X-shaped, or other arbitrary profile. The tray table 100 may further include a spacer 124 (shown in FIGS. 4-7) coupled between the plate 122 and the second end of the horizontal support arm 104 to all for the rotation of the table surface 102. In one embodiment, the second end 105*b* of the horizontal support arm 104 is coupled to the table surface 102 at a center of the table surface 102. In other embodiments, the second end 105*b* of the horizontal support arm 104 is coupled to the table surface 102 offset from the center of the table surface 102.

The horizontal support arm 104 forms a curve that extends from the vertical support beam 106 where the horizontal support arm 104 is coupled to the vertical support beam 106. In some embodiments, the horizontal support arm 104 includes a first section 104*a* and a second section 104*b*. The first section 104*a* may include the curve which may be an arc, such as an arc of an ellipse, circle, compound curve, or the like. The second section 104*b* may be straight or substantially linear. In the illustrated embodiment, the first section 104*a*, the curve of the first section 104*a* may transition into a substantially straight portion 104*c*. The length of the horizontal support arm 104 may be adjustable such that a distance between the vertical support beam 106 and the table surface 102 may be variable. The substantially straight portion 104*c* of the first section 104*a* may receive the second section 104*b* and the second section 104*b* may only extend the length of the substantially straight portion 104*c*. In some embodiments, the horizontal support arm is made of a rigid material, therefore, the second section 104*b* cannot extend into the curve of the first section 104*a*. Accordingly, the length adjustability of the horizontal support arm 104 is based on the length of the substantially straight portion 104*c* as the second section 104*b* may extend within the substantially straight portion 104*c* along the entire length of the substantially straight portion 104*c*. In other words, the change in length of the horizontal support arm 104 is based on the length of the substantially straight portion 104*c* of the first section 104*a*.

In some embodiments, a portion of either the first section 104*a* or the second section 104*b* may be disposed within the second section 104*b* or the first section 104*a*, respectively. Additionally or alternatively, a length of the second section 104*b* is adjustable. Additionally or alternatively, the first section 104*a*, the section 104*b*, or both may be telescoping. The adjustable length of the horizontal support arm 104 may be set by one or more fasteners 116, which may be screws, pegs, spring-loaded fasteners, or any other type of suitable fastener.

Figure 4:
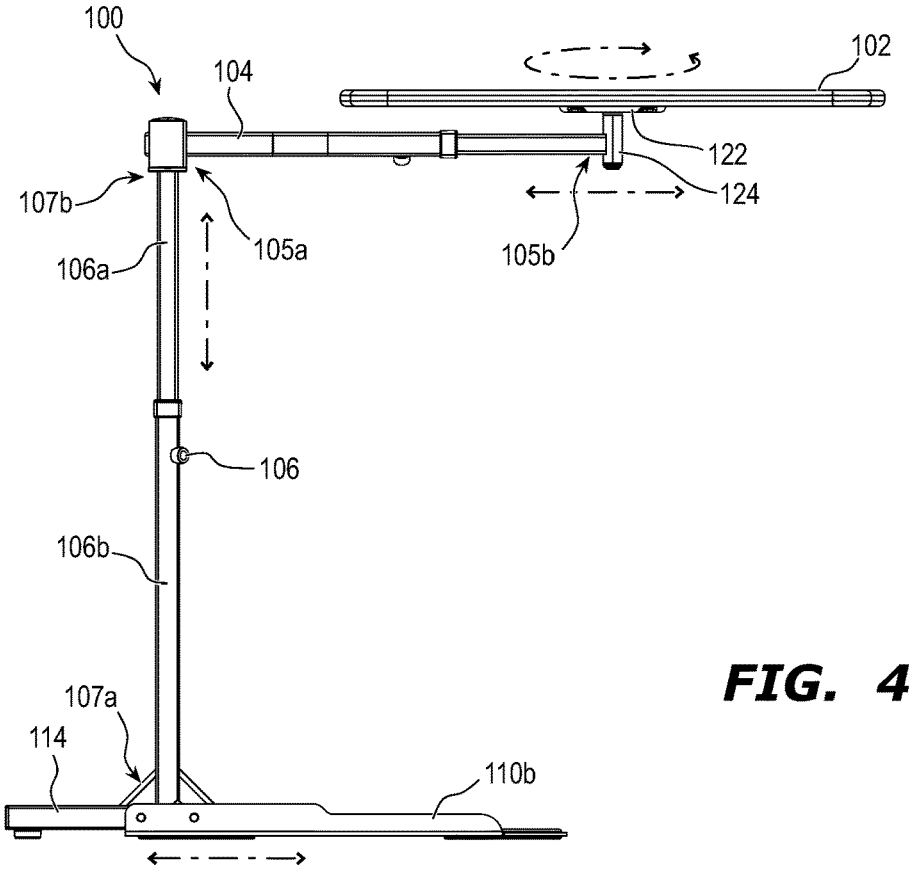
FIG. 4 is a rear view of the tray table of FIG. 1.

FIG. 4 is a rear view of the tray table 100. FIG. 4 shows the tray table 100 as seen from behind the unit of furniture. As discussed above, the height of vertical support beam 106 is adjustable so that the table tray may be customized for a specific user. In some embodiments, the vertical support beam 106 may include a first section 106*a* and a second section 106*b*, allowing the height to be adjustable. For example, a variable portion of the first section 106*a* may be configured to be disposed within the second section 106*b*. Alternatively, a variable portion of the second section 106*b* may be configured to be disposed within the first section 106*a*. Additionally or alternatively, the first section 106*a*, the section 106*b*, or both may be telescoping. The adjustable height of the vertical support beam 106 may be set by one or more fasteners 116, which may be screws, pegs, spring-loaded fasteners, or any other type of suitable fastener.

Figure 5:
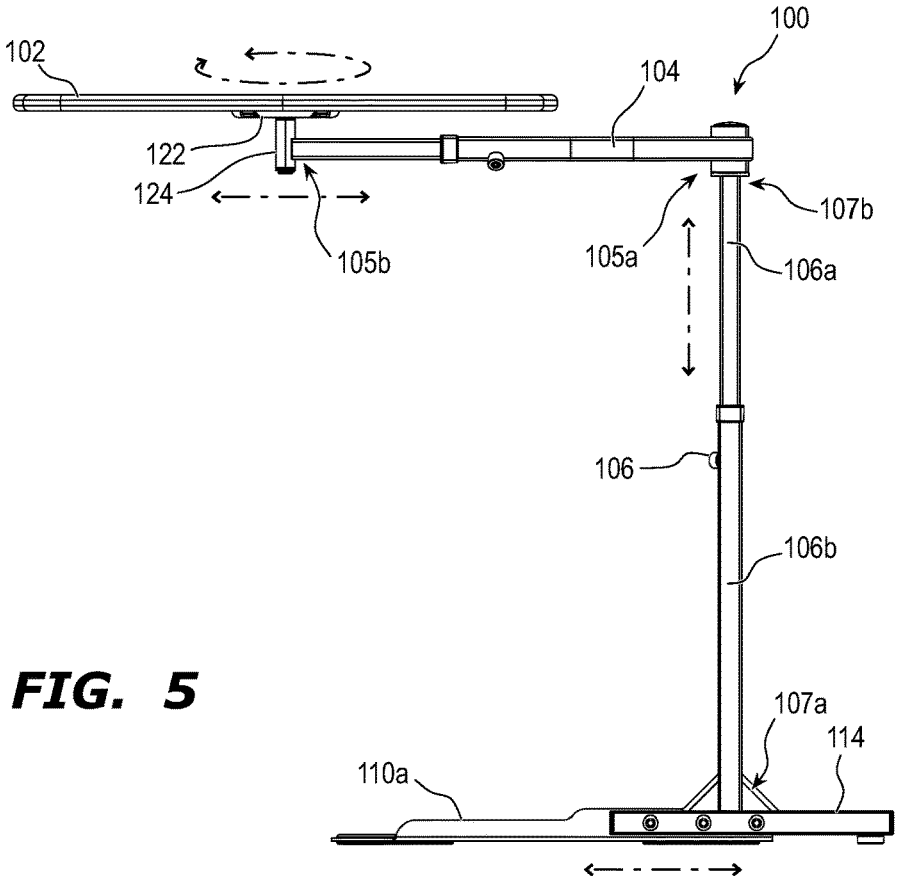
FIG. 5 is a front view of the tray table of FIG. 1.

FIG. 5 is a front view of the tray table 100.

Figure 6:
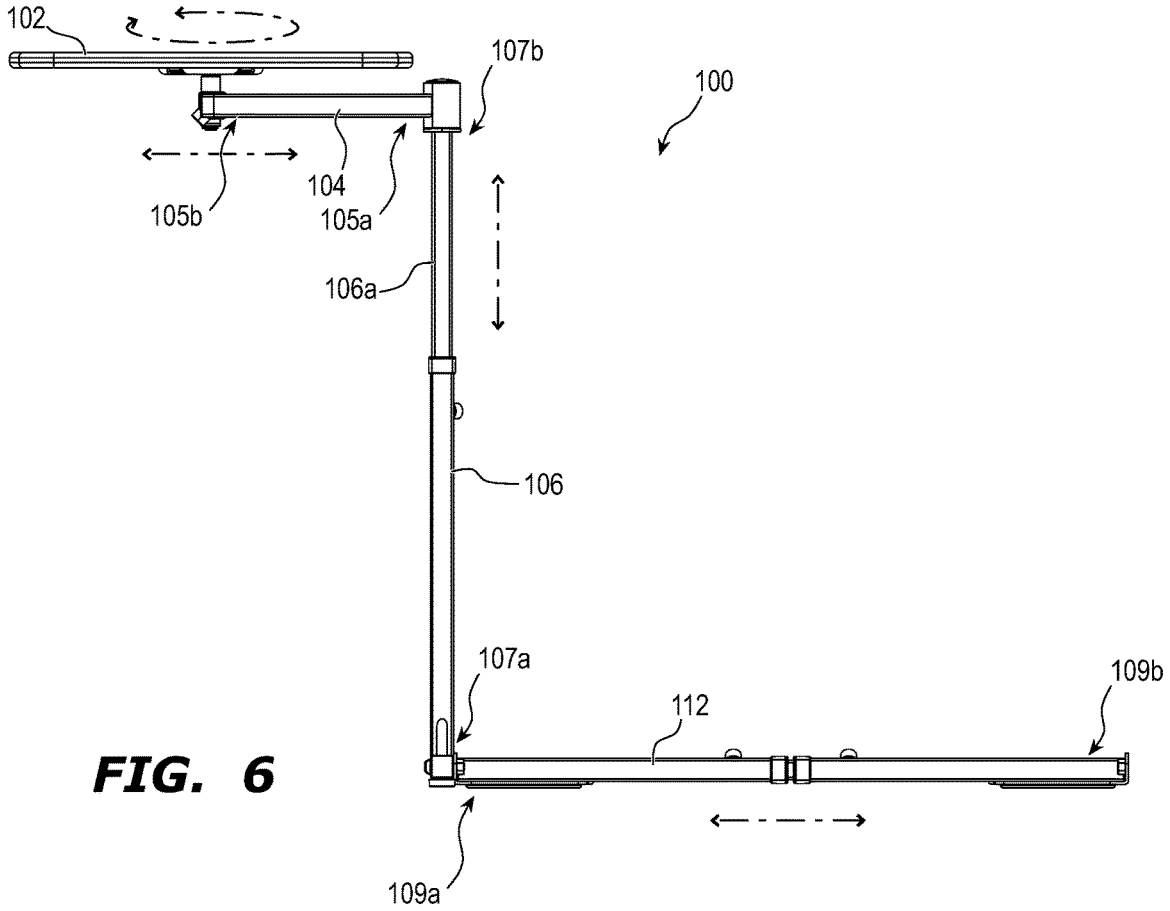
FIG. 6 is a left side view of the tray table of FIG. 1.

FIG. 6 is a left side view of the tray table 100.

Figure 7:
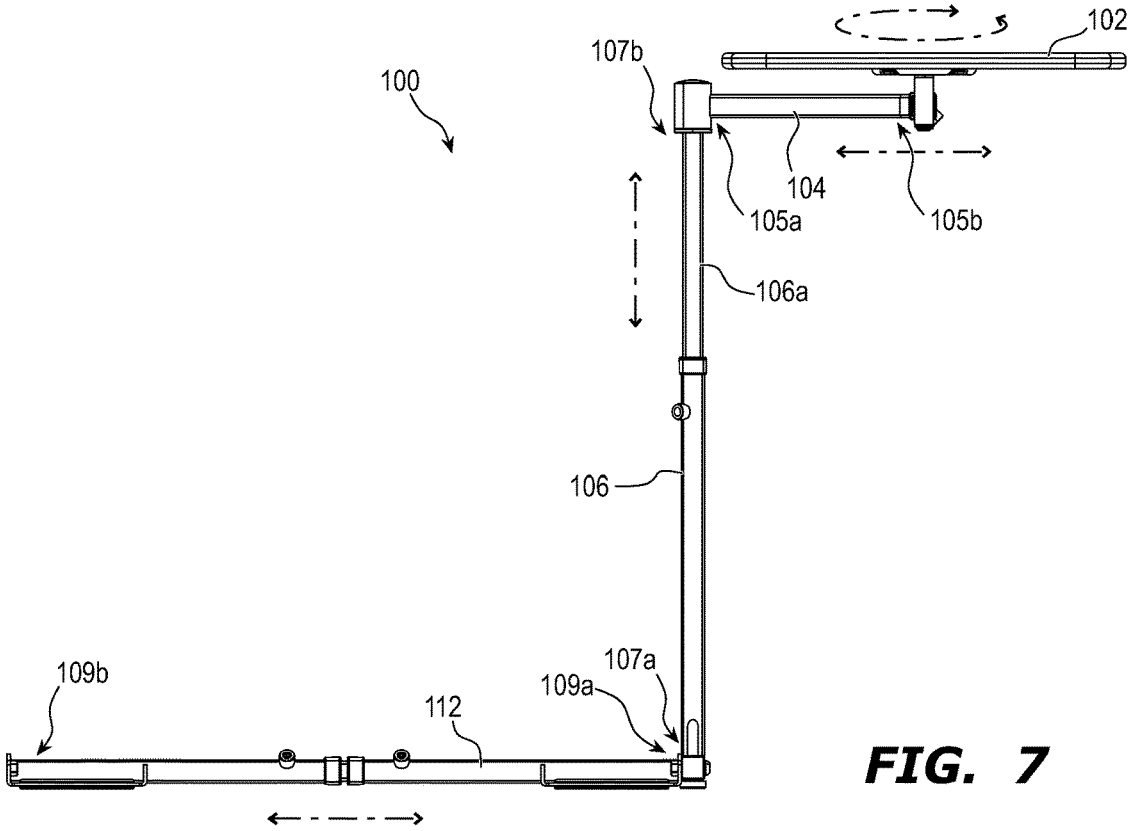
FIG. 7 is a right side view of the tray table of FIG. 1.

FIG. 7 is a right side view of the tray table 100.

Figure 8:
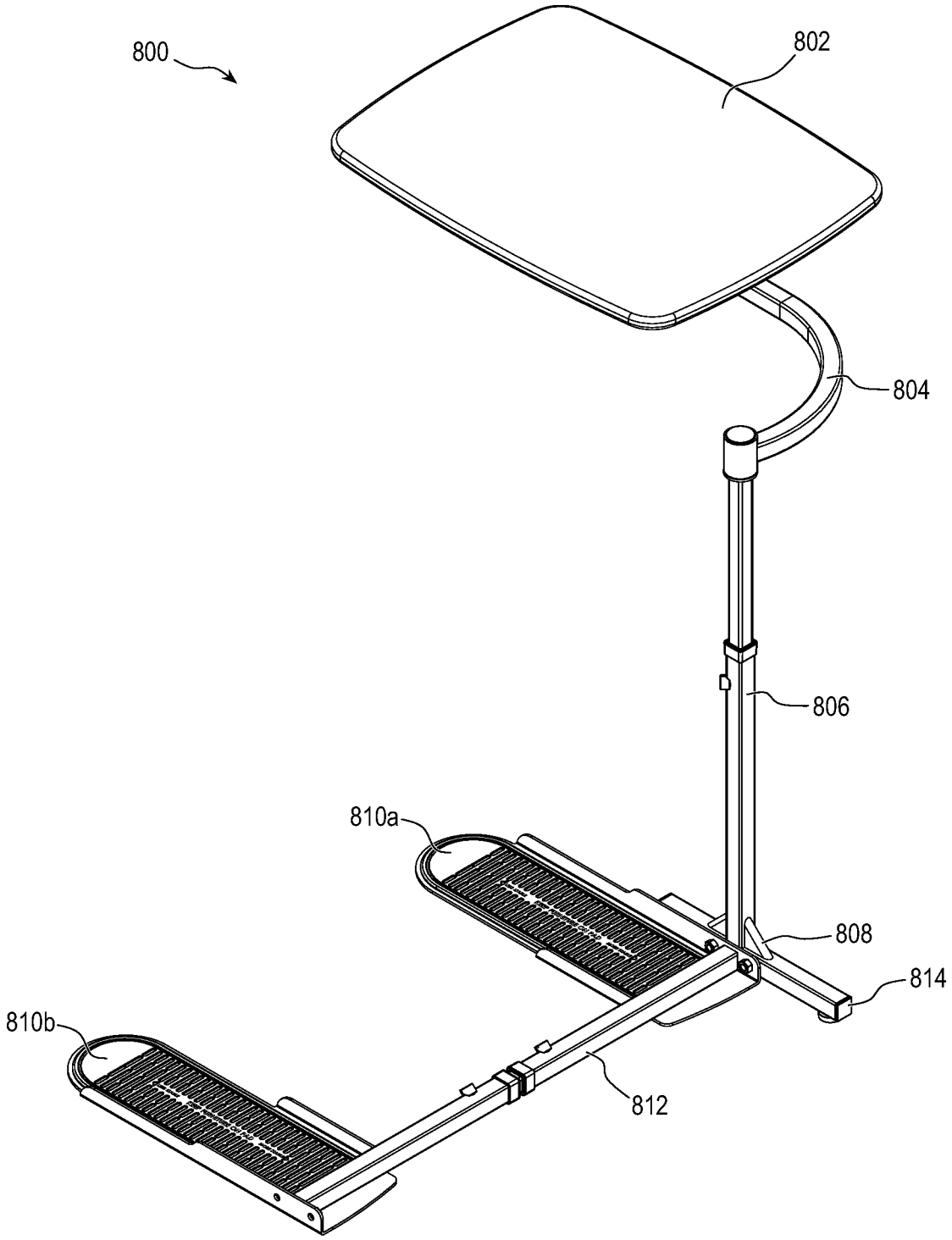
FIG. 8 is a perspective view of a tray table in a right-position configuration, according to one embodiment of the present disclosure.

FIG. 8 depicts an embodiment of a tray table 800 that resembles the tray table 100 described above in certain respects. Accordingly, like features are designated with like reference numerals, with the leading digits incremented to "8." For example, the embodiment depicted in FIGS. 8-19 includes a table surface 802 that may, in some respects, resemble the table surface 102 of FIGS. 1-7. Relevant disclosure set forth above regarding similarly identified features thus may not be repeated hereafter. Moreover, specific features of the tray table 100 and related components shown in FIGS. 1-7 may not be shown or identified by a reference numeral in the drawings or specifically discussed in the written description that follows. However, such features may clearly be the same, or substantially the same, as features depicted in other embodiments and/or described with respect to such embodiments. Accordingly, the relevant descriptions of such features apply equally to the features of the tray table 800 and related components depicted in FIGS. 8-19. Any suitable combination of the features, and variations of the same, described with respect to the tray table 100 and related components illustrated in FIGS. 1-7 can be employed with the tray table 800 and related components of FIGS. 8-19, and vice versa. This pattern of disclosure applies equally to further embodiments depicted in subsequent figures and described hereafter, wherein the leading digits may be further incremented.

FIG. 8 is a perspective view of the tray table 800 in a right-position configuration, according to one embodiment of the present disclosure. The tray table 800 is similar to the tray table 100 of FIGS. 1-7 except that the tray table 800 is configured to be positioned on a right-hand side of a unit of furniture (e.g., from the perspective of a user sitting on the unit of furniture). A plane defined by the table surface 802 (or equivalently the table surface 102) may define a mirror plane. In comparison to the table surface 102, a horizontal support arm 804 is mirrored about the mirror plane compared to the horizontal support arm 104. In other words, the horizontal support arm 104 curves in a first direction and the horizontal support arm 804 curves in a second direction opposite the first direction. Furthermore, first and second platforms 810*a-b* and an opposing bar 814 are oriented opposite compared to the platforms 810*a-b* and the opposing bar 814 in order to allow the tray table 800 to be secured under the legs or base of the unit of furniture on the right-hand side of the unit of furniture. In some embodiments the horizontal support arm may transition in from a first configuration to a second configuration. In the first configuration, the horizontal support arm curves in a first direction, in a second configuration, the horizontal support arm may be removed, flipped over, and reattached thus causing the horizontal support arm to curve in a second direction opposite the first direction.

Figure 9:
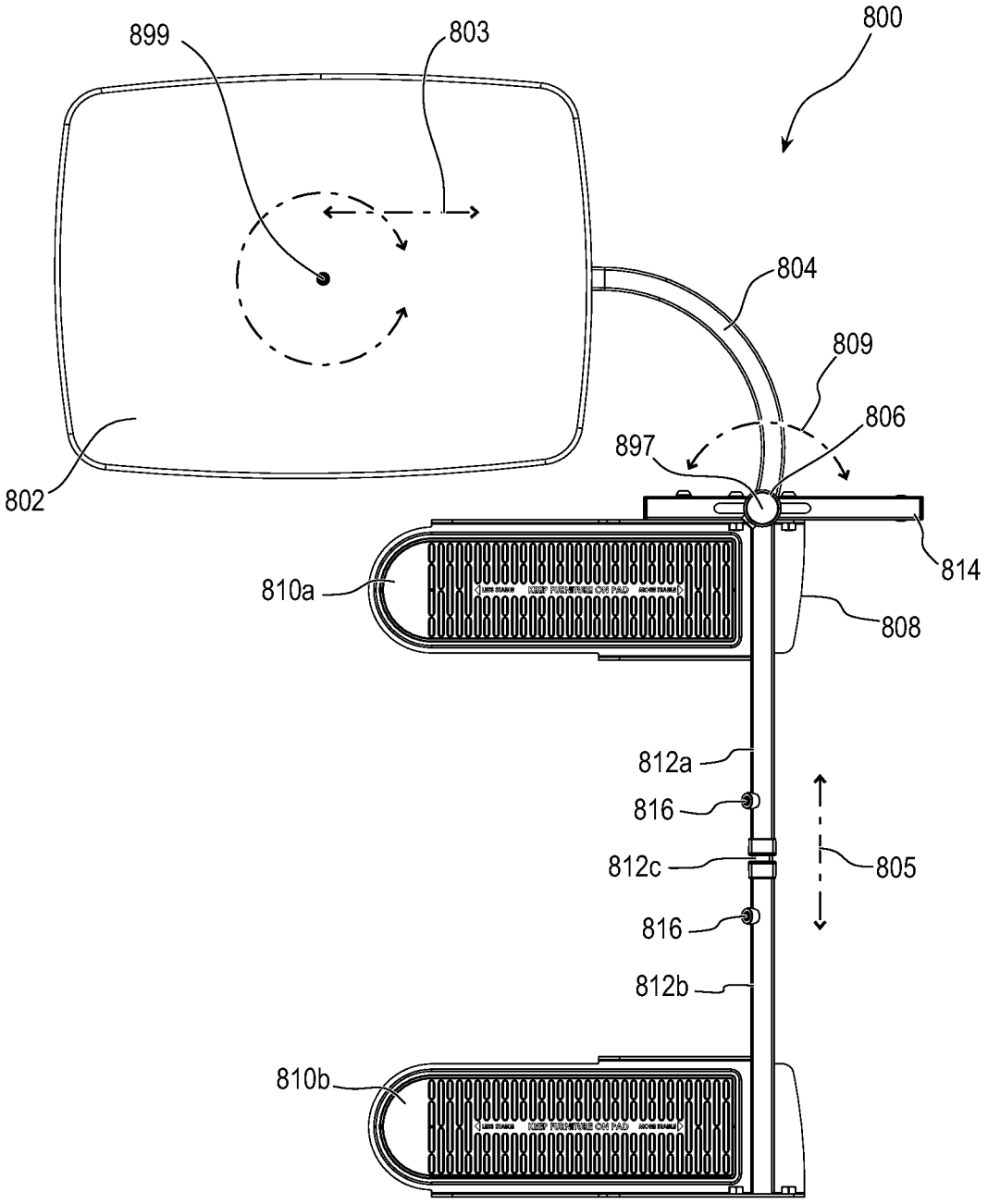
FIG. 9 is a top view of the tray table of FIG. 8.

FIG. 9 is a top view of the tray table 800.

Figure 10:
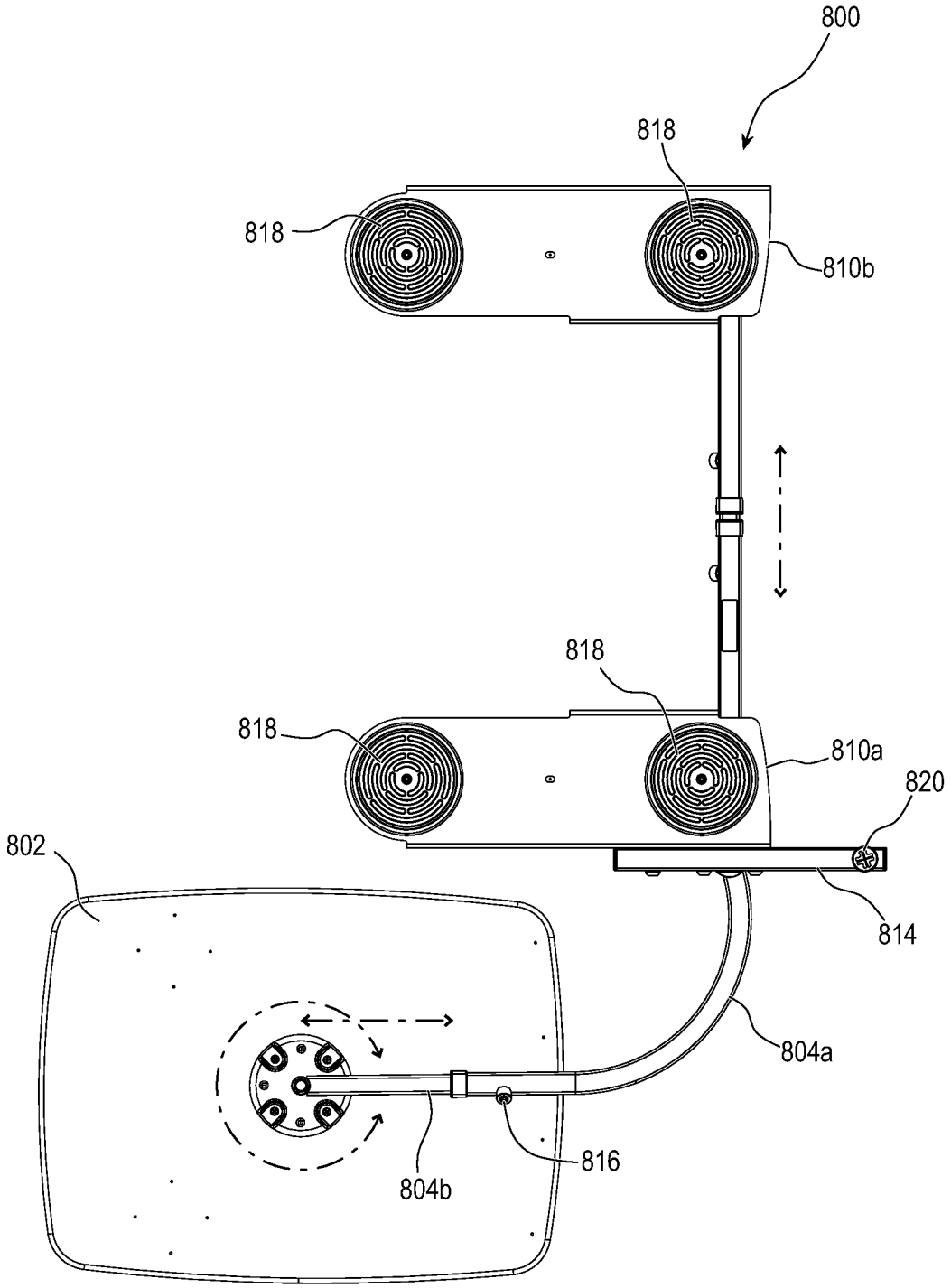
FIG. 10 is a bottom view of the tray table of FIG. 8.

FIG. 10 is a bottom view of the tray table 800.

Figure 11:
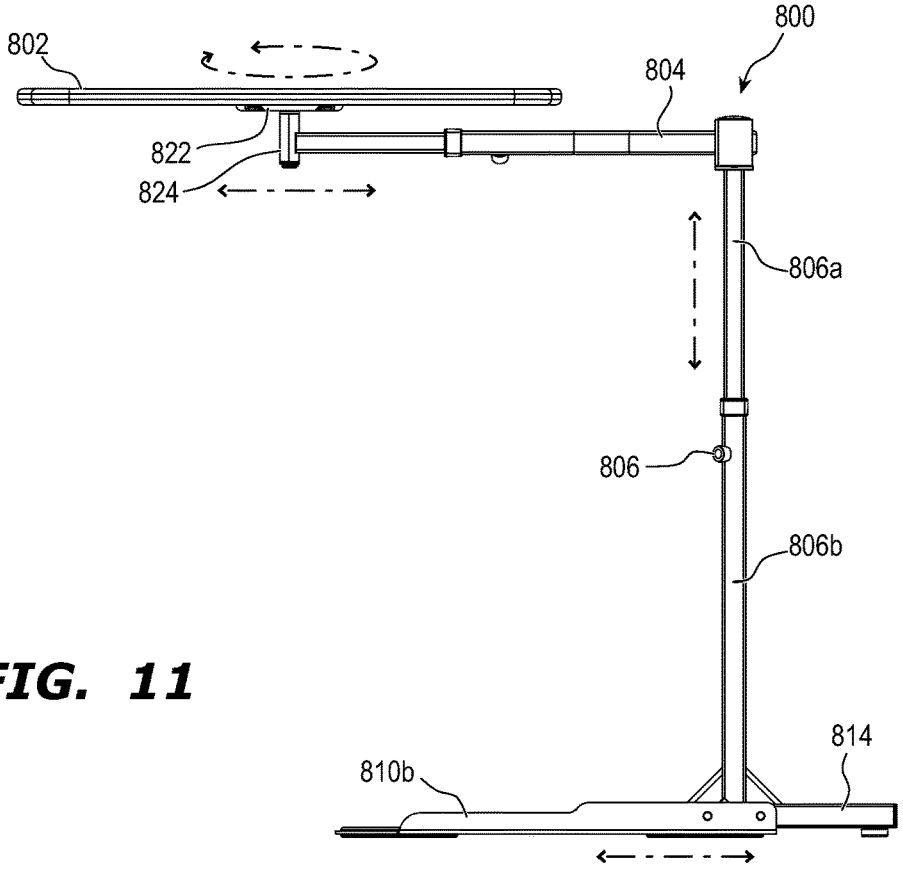
FIG. 11 is a rear view of the tray table of FIG. 8.

FIG. 11 is a rear view the tray table 800.

Figure 12:
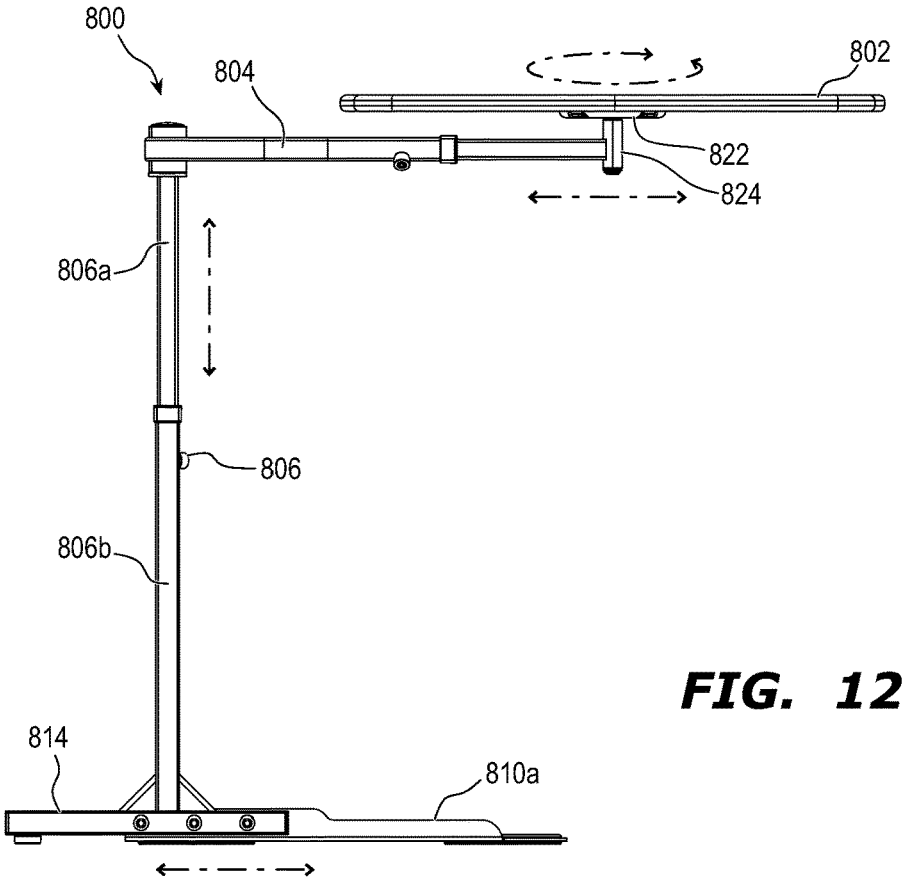
FIG. 12 is a front view of the tray table of FIG. 8.

FIG. 12 is a front view of the tray table 800.

Figure 13:
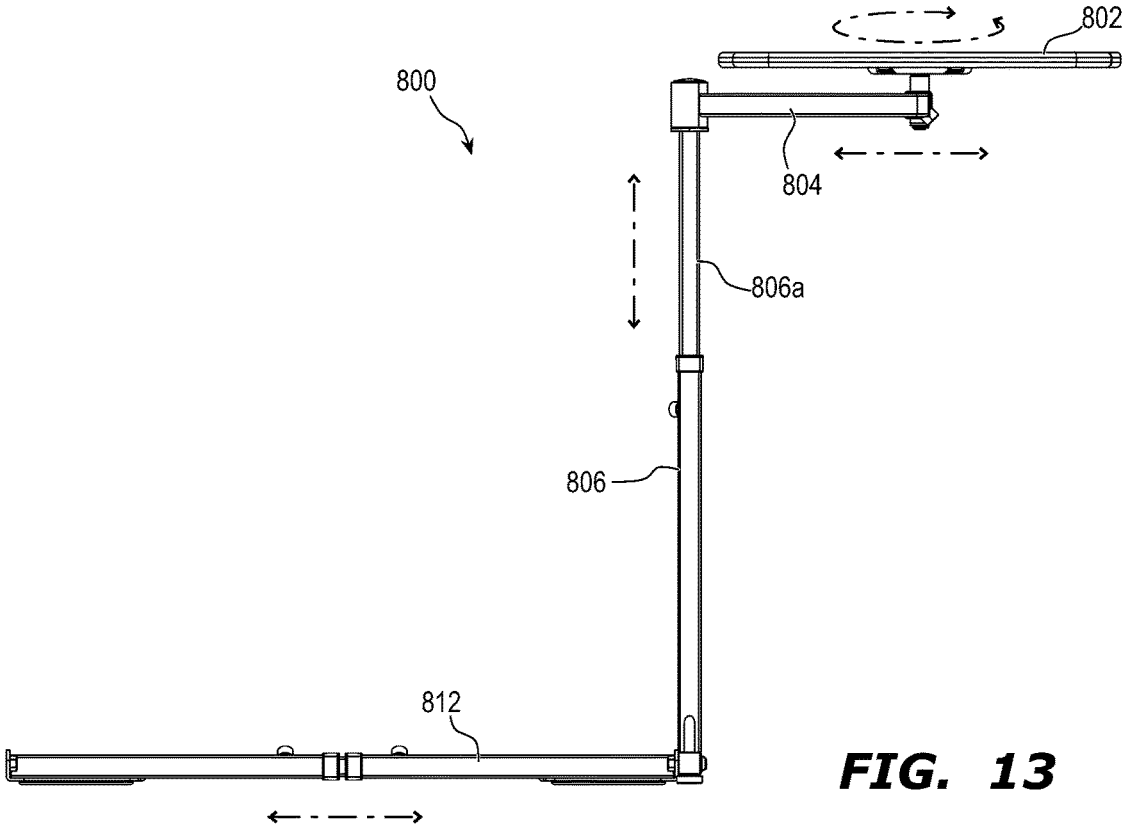
FIG. 13 is a left view of the tray table of FIG. 8.

FIG. 13 is a left side view of the tray table 800.

Figure 14:
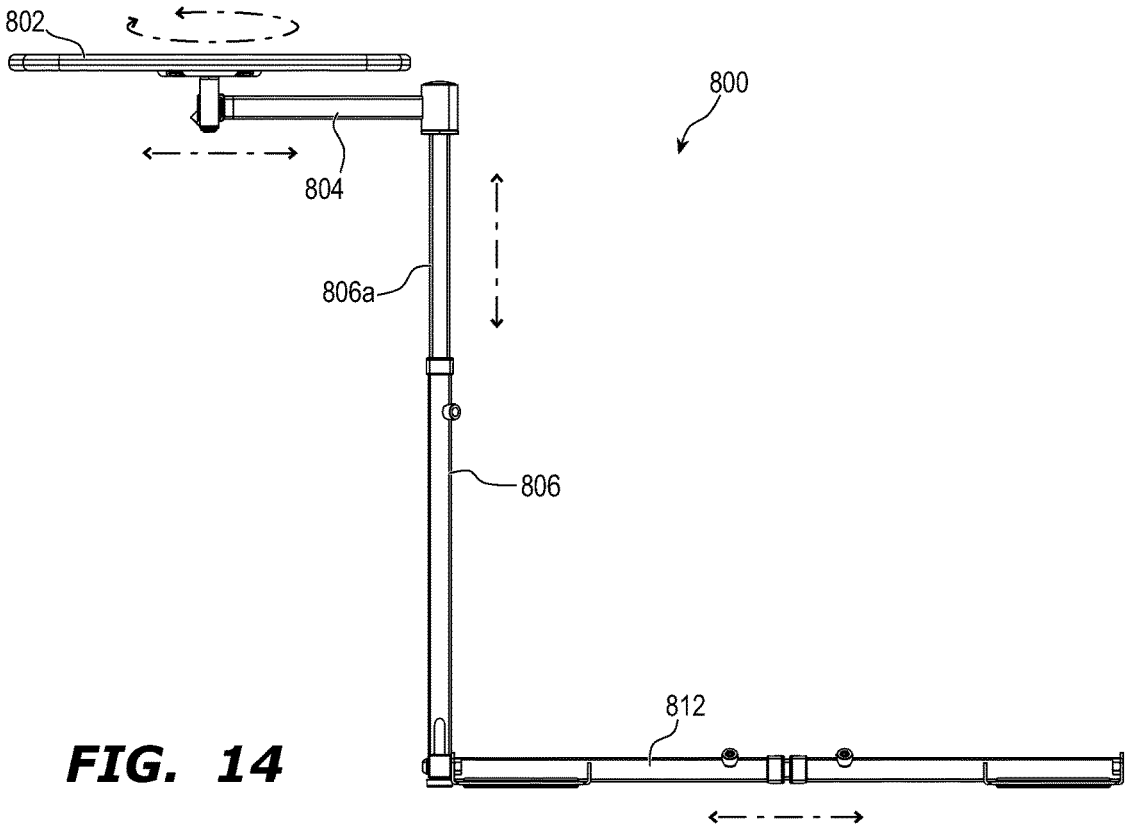
FIG. 14 is a right view of the tray table of FIG. 8.

FIG. 14 is a right side view of the tray table 800.

Figure 15:
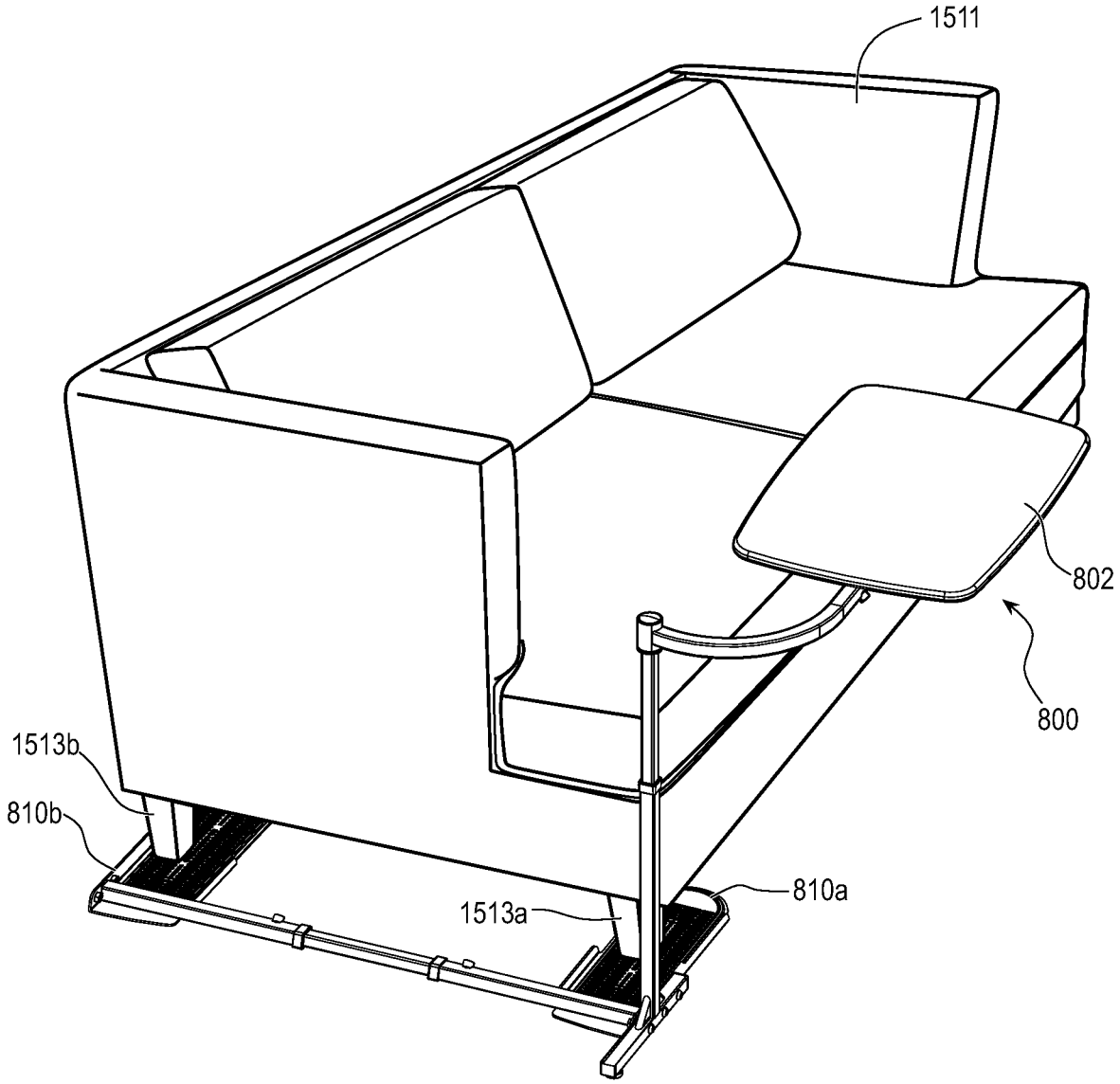
FIG. 15 is a perspective view of a tray table in a first position and used in conjunction with a sofa, according to one embodiment of the present disclosure.
Figure 16:
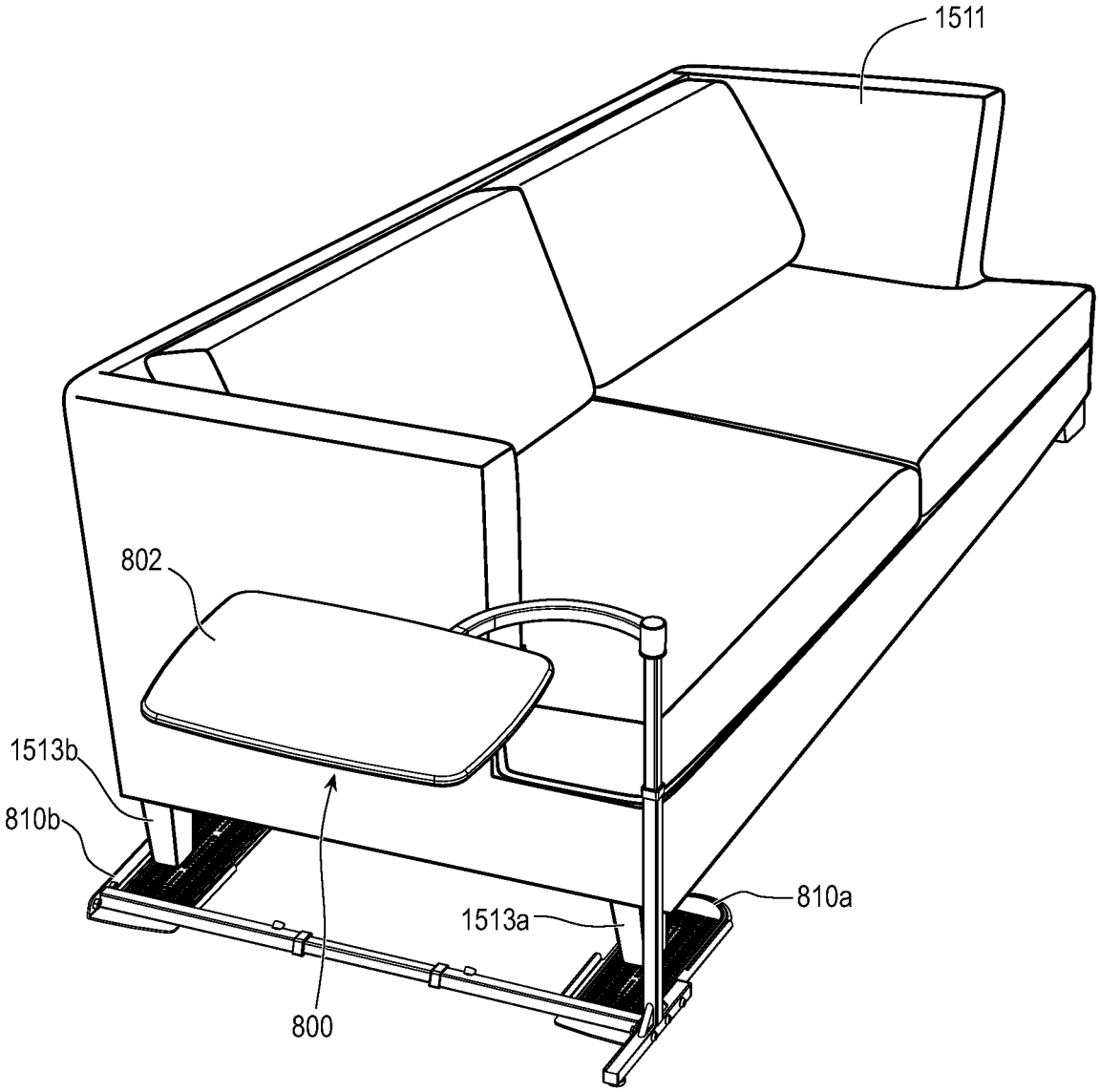
FIG. 16 is a perspective view of the tray table FIG. 15 in a second position.

FIG. 15 is a perspective view of the tray table 800 in the first position when used in conjunction with a sofa 1511, according to one embodiment of the present disclosure. As illustrated in FIG. 15, the tray table 800 has a right-position configuration. The first position of the tray table 800 positions the table surface 802 near a front of the sofa 1511 thus enabling a user to use the tray table 800 when sitting on the sofa 1511. The first and second platforms 810*a-b* of the tray table 800 are disposed underneath legs 1513*a-b*, respectively, of the sofa 1511 to secure the tray table 800 in an upright position.

FIG. 16 is a perspective view of the tray table 800 in the second position when used in conjunction with the sofa 1511, according to one embodiment of the present disclosure. The second position of the tray table 800 positions the table surface 802 adjacent to the sofa 1511.

Figure 17:
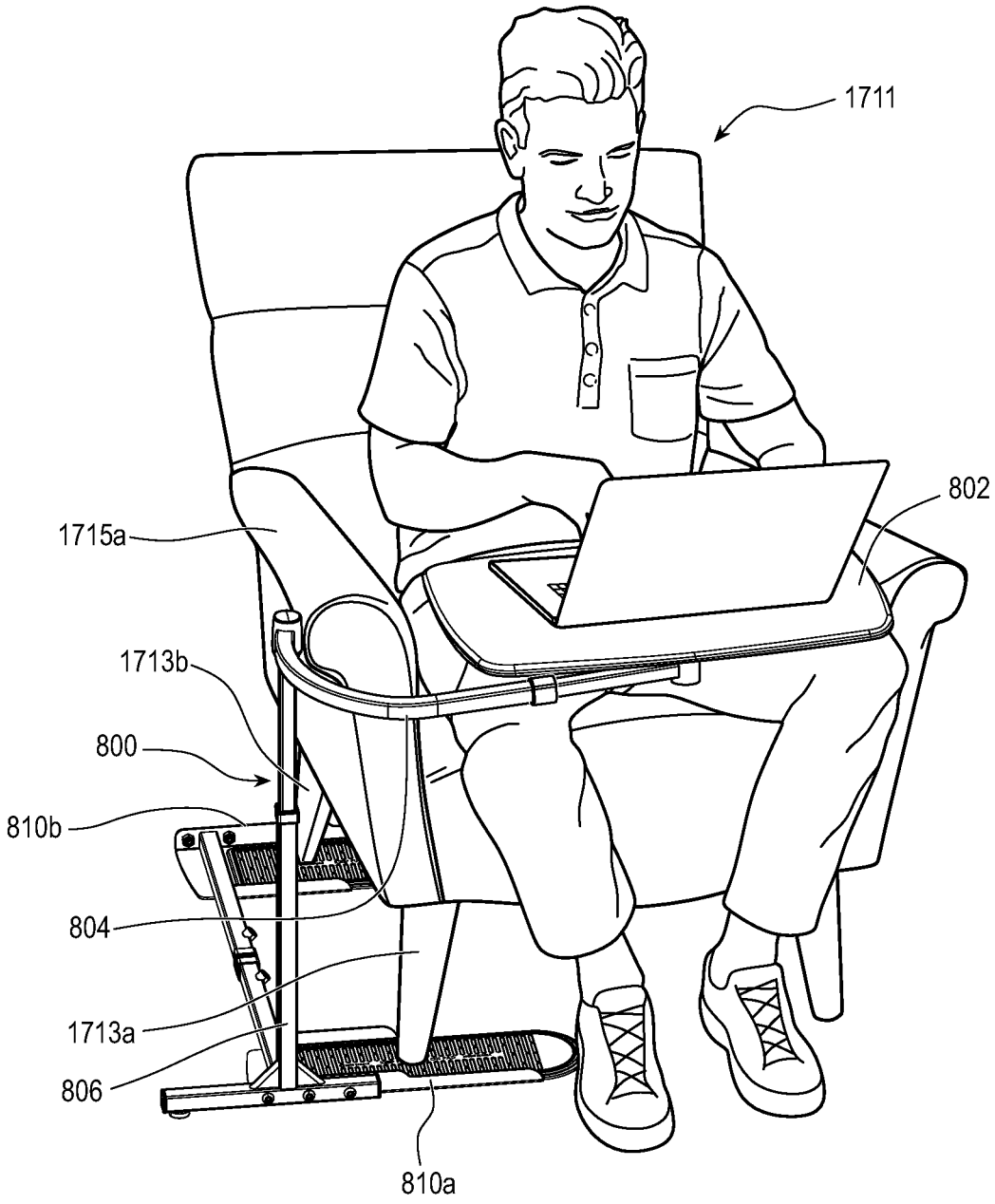
FIG. 17 is a perspective view of a tray table with a right-position configuration in a first position and used in conjunction with an armchair, according to one embodiment of the present disclosure.
Figure 18:
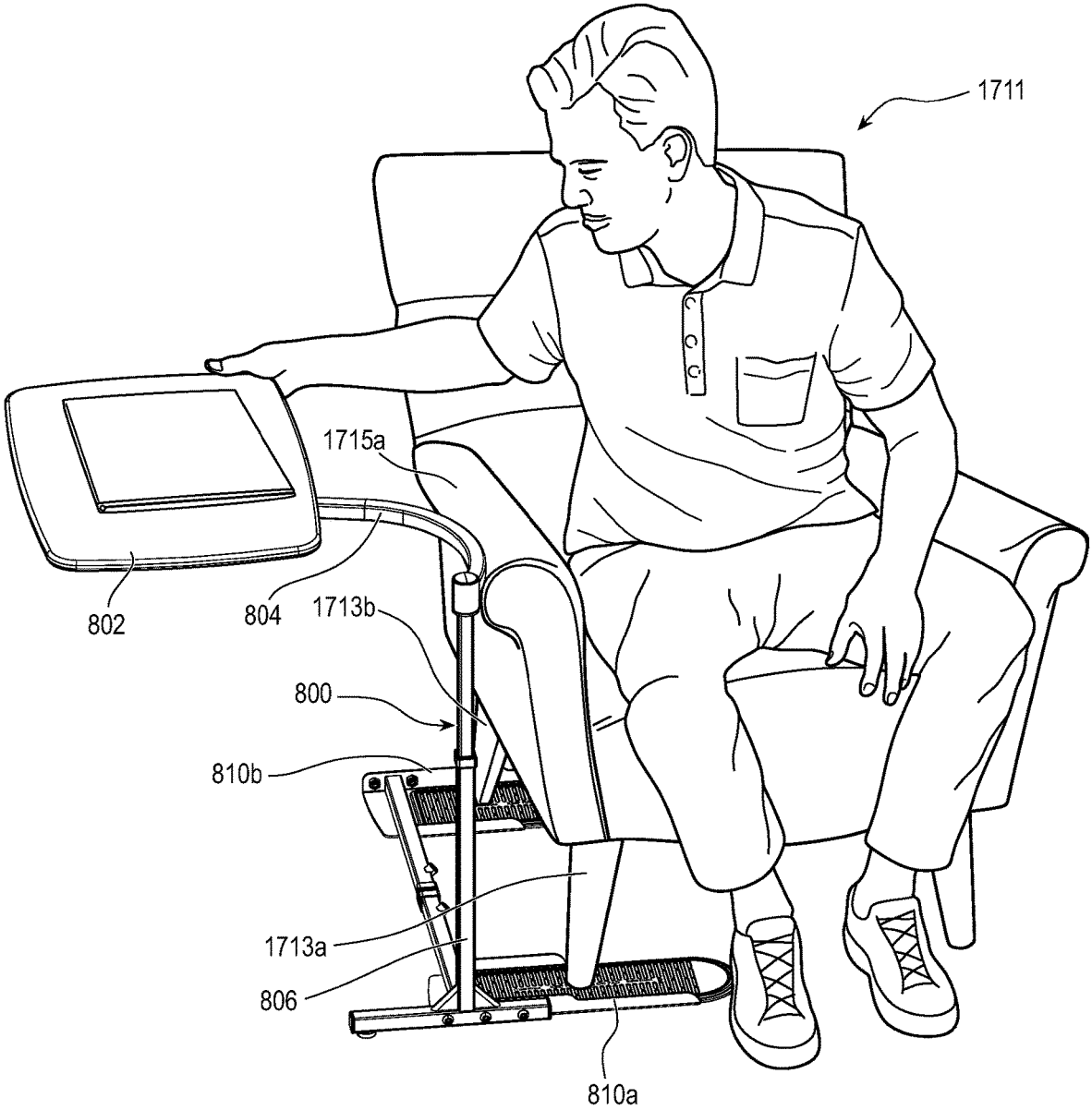
FIG. 18 is a perspective view of the tray table of FIG. 17 in a second position.

FIG. 17 is a perspective view of the tray table 800 with the right-position configuration in the first position and used in conjunction with an armchair 1711, according to one embodiment of the present disclosure. As illustrated in FIG. 17, the tray table 800 has a right-position configuration with the first and second platforms 810*a-b* disposed underneath legs 1713*a-b* and the table surface 802 is disposed in the first position. The armrests of the armchair 1711 are different than the armrests of the sofa 1511 in that the armrests of the armchair 1711 extend outwards toward a front side of the armchair 1711 and may be taller than the armrests of the sofa 1511. However, the adjustability and the design of the tray table 800 enables the tray table 800 to be used with a variety of different units of furniture and a variety of different sized users.

As discussed above, the height of the vertical support beam 806 is adjustable thereby enabling the height of the horizontal support arm 804 and the table surface 802 to be height adjustable. The adjustability of the vertical support beam 806 enables the height of the horizontal support arm 804 and the table surface 802 to be at a comfortable position for the user. Although armrests of the armchair 1711 may extend outwards (towards a front side of the armchair 1711) and may be taller than armrests of the sofa 1511, the curved profile of the horizontal support arm 804 enables the horizontal support arm 804 to curve around the armrest of the armchair 1711 so that the table surface 802 is disposed above a seating surface of the armchair 1711 and above the lap or legs of the user. This is not an issue when the height of the horizontal support arm 804 and the table surface 802 are above the height of the armrest because the horizontal support arm 804 does not interact with the armrests. However, in the case when the height of the vertical support beam 806 is less than a height of the armrests, the table surface 802 may still be disposed in a comfortable position for the user, due, at least in part, to the curved profile of the horizontal support arm 804 curving around the armrest. Alternatively, if the horizontal support arm 804 did not have a curved profile and was simply straight, the horizontal support arm 804 would be hindered by the armrest preventing the table surface 802 from being disposed above the seating surface of the armchair 1711 and/or the lap of the user sitting in the armchair 1711.

FIG. 18 is a perspective view of the tray table 800 with the right-position configuration in the second position when used in conjunction with the armchair 1711, according to one embodiment of the present disclosure. As illustrated in FIG. 18, when the tray table 800 is disposed in the second position, the user can sit down on the armchair 1711 and/or stand up from the armchair 1711 without being hindered by the tray table 800.

Figure 19:
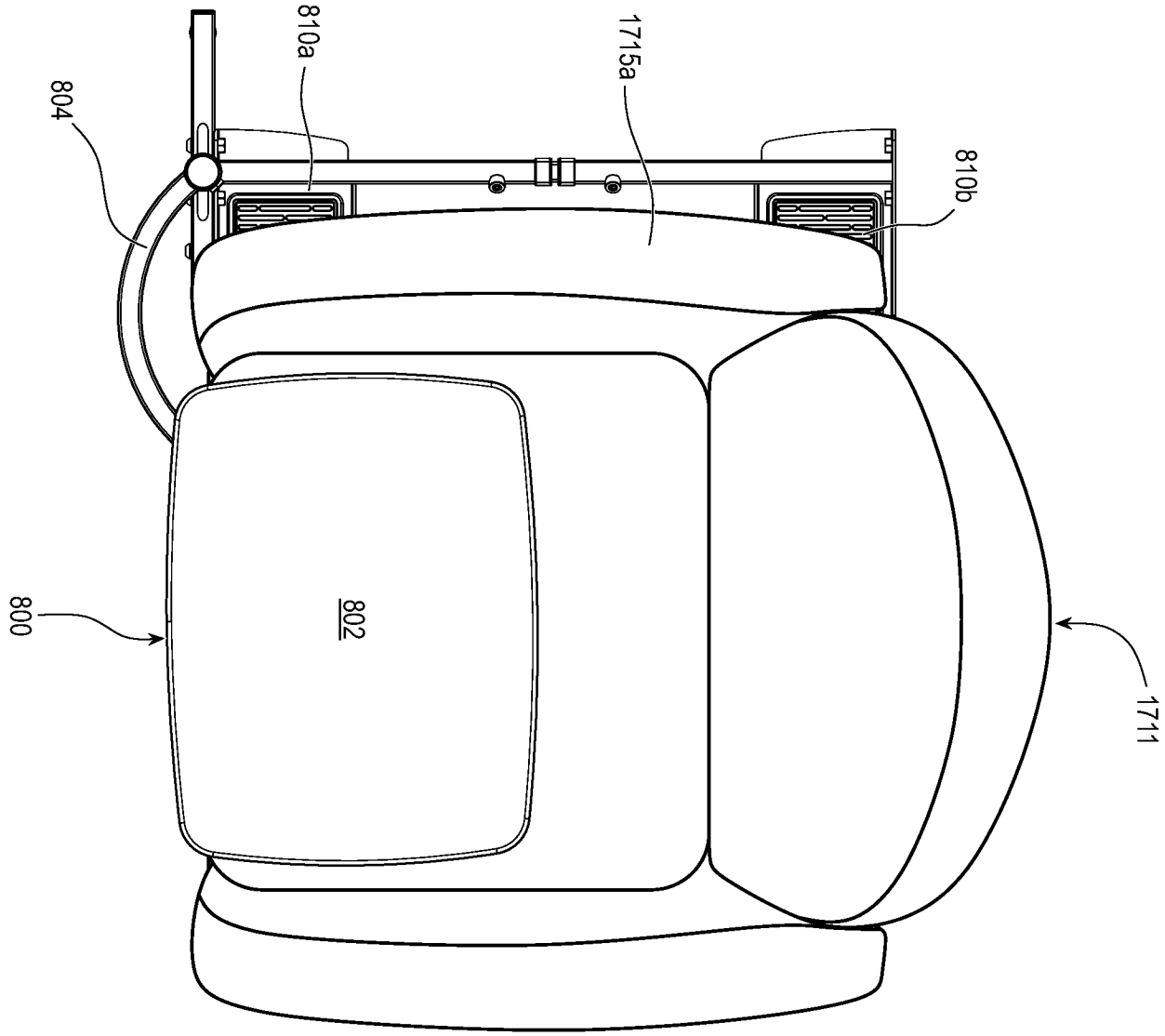
FIG. 19 is a top view of the tray table of FIG. 17 in the first position.

FIG. 19 is a top view of the tray table 800 in the first position when used in conjunction with the armchair 1711, according to one embodiment of the present disclosure. As illustrated, the tray table 800 may be positioned in the first position to be used by the user with no component of the tray table 800 which is hindered by the armchair 1711, and similar with no component of the tray table 800 which hinders the user. In other words, the curved profile of the horizontal support arm 804 curves around the armrest of the armchair 1711 enabling the table surface 802 to be above a sitting position of the armchair 1711.

Figure 20:
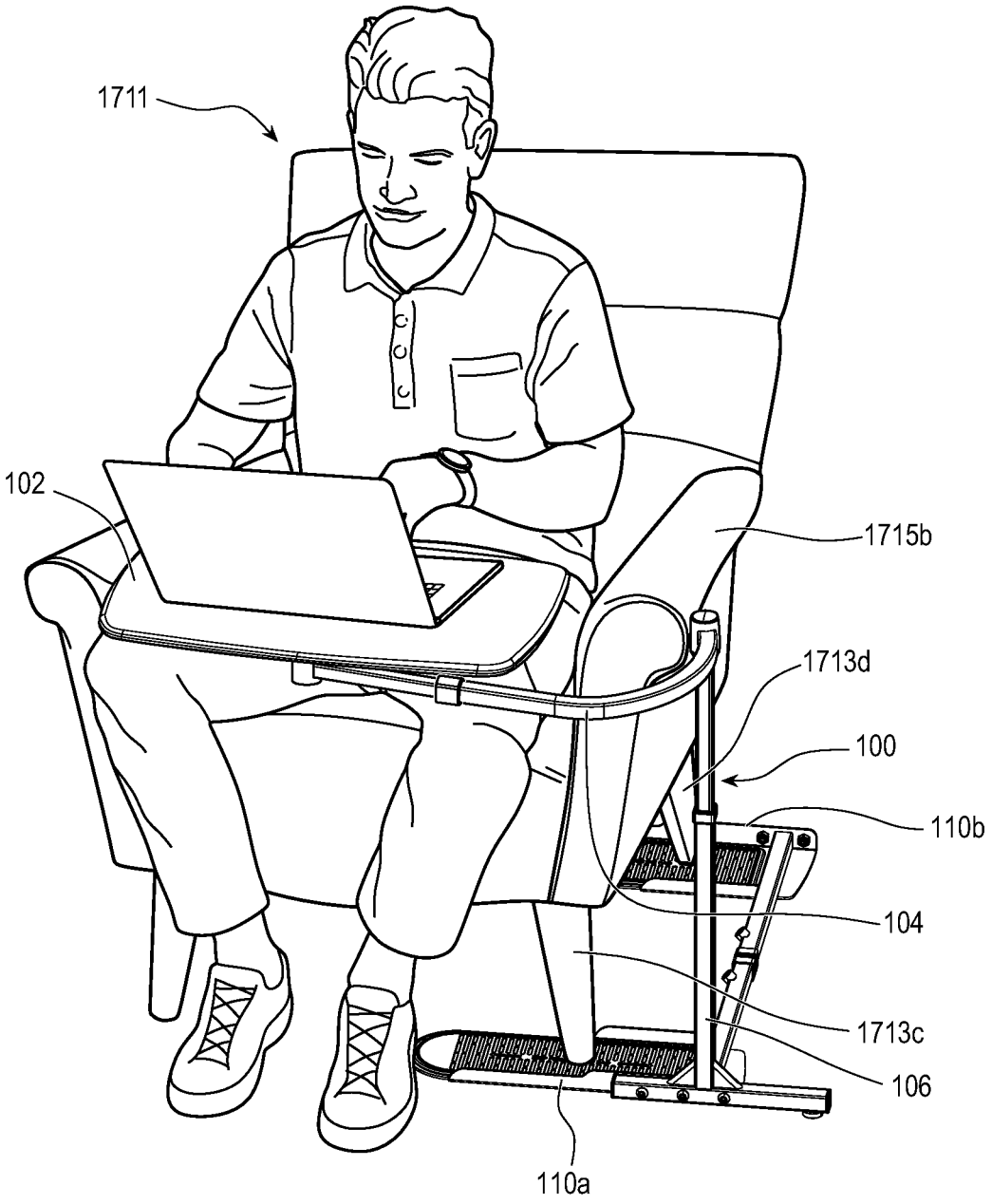
FIG. 20 is a perspective view of a tray table with the left-position configuration in a first position and used in conjunction with an armchair, according to one embodiment of the present disclosure.
Figure 21:
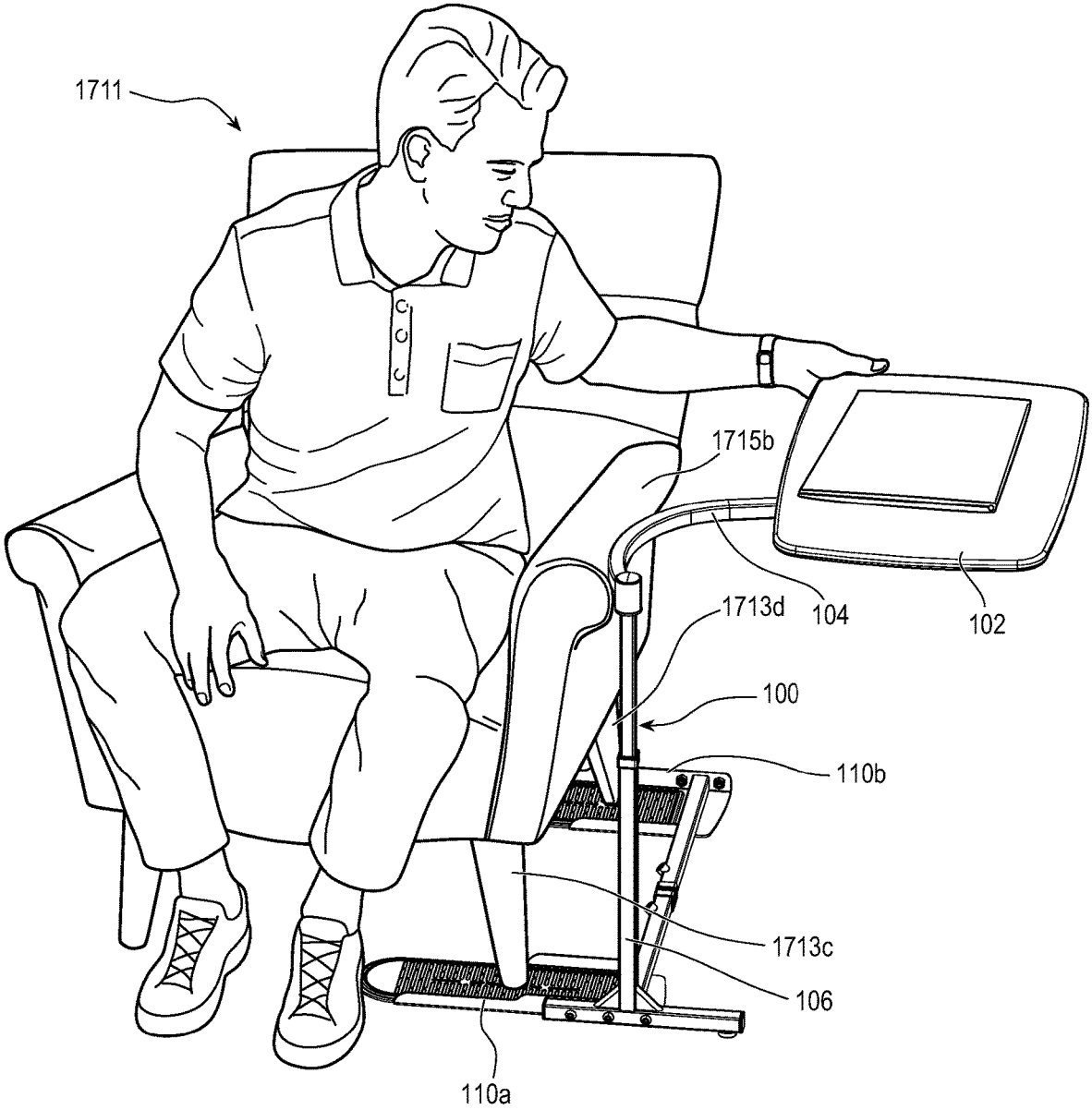
FIG. 21 is a perspective view of the tray table of FIG. 20 in a second position.

FIG. 20 is a perspective view of the tray table 100 with the left-position configuration in the first position and used in conjunction with the armchair 1711, according to one embodiment of the present disclosure. As illustrated in FIG. 20, the first and second platforms 110*a-b* of the tray table 100 are disposed underneath legs 1713*c-d* of the armchair 1711 and the table surface 102 is disposed in the first position. The armrests of the armchair 1711 are different than the armrests of the sofa 1511 in that the armrests of the armchair 1711 extend outwards toward a front side of the armchair 1711 and may be taller than the armrests of the sofa 1511. However, the adjustability and the design of the tray table 100 enables the tray table 100 to be used with a variety of different units of furniture and a variety of different sized users.

As discussed above, the height of the vertical support beam 106 is adjustable thereby enabling the height of the horizontal support arm 104 and the table surface 102 to be height adjustable. The adjustability of the vertical support beam 106 enables the height of the horizontal support arm 104 and the table surface 102 to be at a comfortable position for the user. Although armrests of the armchair 1711 may extend outwards (towards a front side of the armchair 1711) and may be taller than armrests of the sofa 1511, the curved profile of the horizontal support arm 104 enables the horizontal support arm 104 to curve around the armrest of the armchair 1711 so that the table surface 102 is disposed above a seating surface of the armchair 1711 and above the lap or legs of the user. This is not an issue when the height of the horizontal support arm 104 and the table surface 102 are above the height of the armrest because the horizontal support arm 104 does not interact with the armrest. However, in the case when the height of the vertical support beam 106 is less than a height of the armrest, the table surface 102 may still be disposed in a comfortable position for the user, due, at least in part, to the curved profile of the horizontal support arm 104 curving around the armrest. Alternatively, if the horizontal support arm 104 did not have a curved profile and was simply straight, the horizontal support arm 104 would be hindered by the armrest preventing that table surface 102 from being disposed above the seating surface of the armchair 1711 and/or the lap of the user sitting in the armchair 1711.

FIG. 21 is a perspective view of the tray table 100 with the left-position configuration in the second position when used in conjunction with the armchair 1711, according to one embodiment of the present disclosure. As illustrated in FIG. 21, when the tray table 100 is disposed in the second position, the user can sit down on the armchair 1711 and/or stand up from the armchair 1711 without being hindered by the tray table 100.

Figure 22:
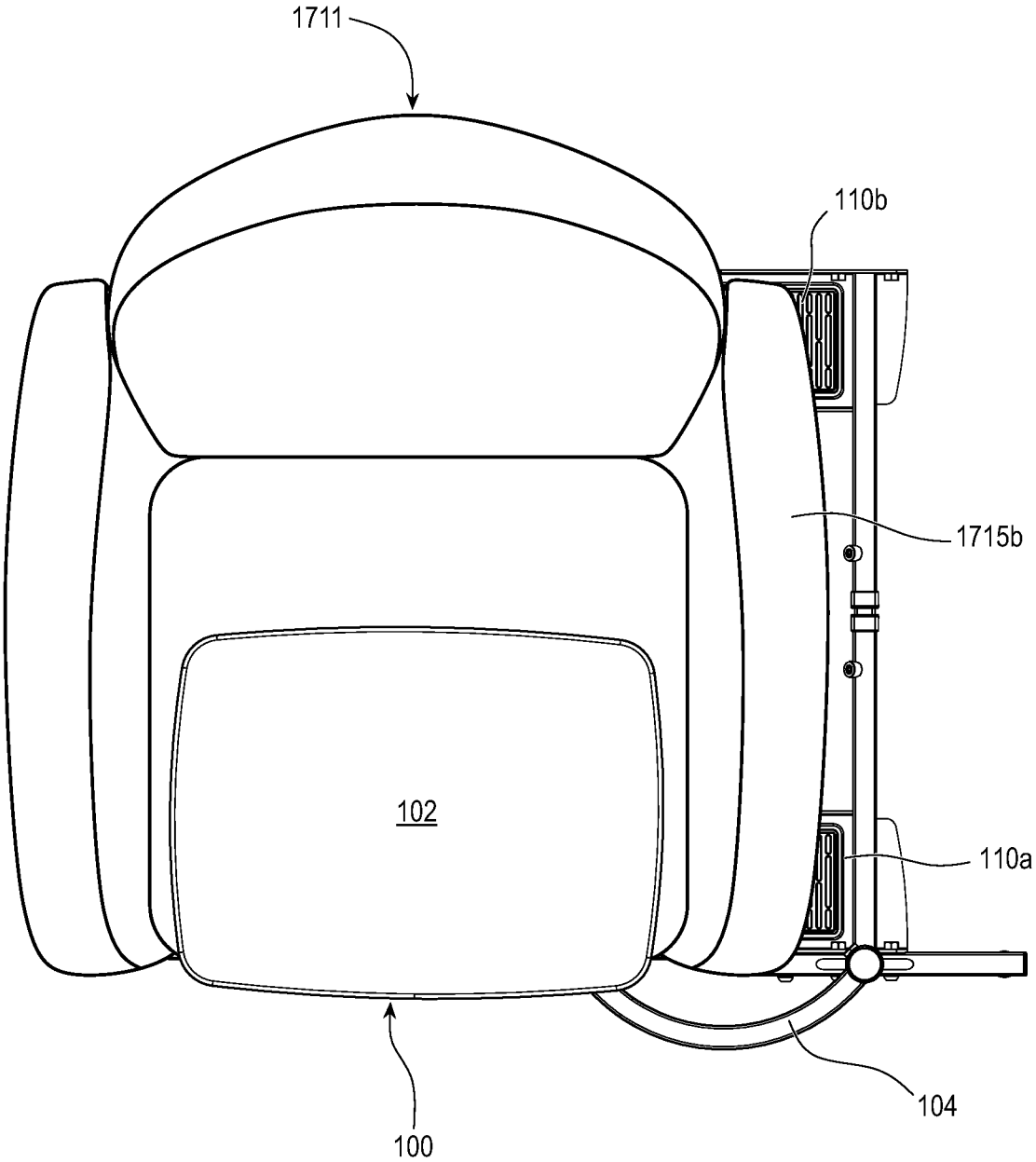
FIG. 22 is a top view of the tray table of FIG. 20 in the first position.

FIG. 22 is a top view of the tray table 100 in the first position when used in conjunction with the armchair 1711, according to one embodiment of the present disclosure. As illustrated, the tray table 100 may be positioned in the first position to be used by the user with no component of the tray table 100 which is hindered by the armchair 1711, and similar with no component of the tray table 100 which hinders the user. In other words, the curved profile of the horizontal support arm 104 curves around the armrest of the armchair 1711 enabling the table surface 102 to be above a sitting position of the armchair 1711.

In some embodiments, the tray table may come packaged in a kit enabling a user to assemble the tray table into the left-position configuration tray table 100 or the right-position configuration tray table 800. In other words, a kit may include all of the components needed to assembly the tray table 100 in the left-position configuration or the tray table 800 in the right-position configuration. Specifically, the components of the tray table may be assembled so that the platforms 110*a-b*, 810*a-b* may be assembled in the left-position configuration or the right-position configuration and be disposed under a unit of furniture. Further, the components of the tray table may be assembled so that that the horizontal support arm 104 is disposed in the first configuration so that the horizontal support arm 104 curves in a first direction toward the unit of furniture in the left-position configuration or in a second configuration so that the horizontal support arm 804 curves in a second direction opposite the first direction but still toward the unit of furniture in the right-position configuration. Accordingly, the tray table kit enables the tray table to be assembled to accommodate the needs of the user. Instructions for assembling the table tray may be in a booklet packaged with the table tray or instructions may direct a user a website with directions and/or video instructions for assembling the tray table.

While specific embodiments of tray tables have been illustrated and described, it is to be understood that the disclosure provided is not limited to the precise configuration and components disclosed. Various modifications, changes, and variations apparent to those of skill in the art may be made in the arrangement, operation, and details of the methods and systems disclosed, with the aid of the present disclosure.

References to approximations are made throughout this specification, such as by use of the term "substantially." For each such reference, it is to be understood that, in some embodiments, the value, feature, or characteristic may be specified without approximation. For example, where qualifiers such as "about" and "substantially" are used, these terms include within their scope the qualified words in the absence of their qualifiers. For example, where the term "substantially parallel" is recited with respect to a feature, it is understood that in further embodiments, the feature can have a precisely parallel configuration.

Similarly, in the above description of embodiments, various features are sometimes grouped together in a single embodiment, figure, or description thereof for the purpose of streamlining the disclosure. This method of disclosure, however, is not to be interpreted as reflecting an intention that any claim require more features than those expressly recited in that claim. Rather, as the following claims reflect, inventive aspects lie in a combination of fewer than all features of any single foregoing disclosed embodiment.

The claims following this written disclosure are hereby expressly incorporated into the present written disclosure, with each claim standing on its own as a separate embodiment. This disclosure includes all permutations of the independent claims with their dependent claims. Moreover, additional embodiments capable of derivation from the independent and dependent claims that follow are also expressly incorporated into the present written description.

Without further elaboration, it is believed that one skilled in the art can use the preceding description to utilize the invention to its fullest extent. The claims and embodiments disclosed herein are to be construed as merely illustrative and exemplary, and not a limitation of the scope of the present disclosure in any way. It will be apparent to those having ordinary skill in the art, with the aid of the present disclosure, that changes may be made to the details of the above-described embodiments without departing from the underlying principles of the disclosure herein. In other words, various modifications and improvements of the embodiments specifically disclosed in the description above are within the scope of the appended claims. Moreover, the order of the steps or actions of the methods disclosed herein may be changed by those skilled in the art without departing from the scope of the present disclosure. In other words, unless a specific order of steps or actions is required for proper operation of the embodiment, the order or use of specific steps or actions may be modified. The scope of the invention is therefore defined by the following claims and their equivalents.

What is claimed is:

1. A furniture table comprising:
a table surface;
a base comprising:
a first foot and a second foot that extend in a first direction and are longitudinally separated; and
a third foot that extends in a second direction opposite the first direction,
wherein lengths of the first foot and the second foot are longer than a length of the third foot;
a vertical support beam with a first end and a second end, the first end being coupled to the base; and
a horizontal support arm with a first end coupled to the table surface and a second end coupled to the second end of the vertical support beam,
wherein the first end of the vertical support beam is couplable to either a first end or a second end of the base.

2. The furniture table of claim 1, wherein the horizontal support arm comprises a first section and a second section, wherein the first section comprises an arcuate shaped portion and the second section is straight.

3. The furniture table of claim 1, wherein the horizontal support arm is rotatable about a longitudinal axis of the vertical support beam.

4. The furniture table of claim 1, wherein the table surface is rotatable about a transverse axis of the table surface, the transverse axis being parallel to the vertical support beam.

5. The furniture table of claim 1, wherein a distance between the table surface and the vertical support beam is adjustable.

6. The furniture table of claim 1, wherein the horizontal support arm is couplable to the second end of the vertical support beam in a first configuration and a second configuration, wherein in the first configuration the horizontal support arm curves in a first direction and in the second configuration the horizontal support arm curves in a second direction that is opposite the first direction.

7. The furniture table of claim 1, wherein a height of the vertical support beam is adjustable.

8. The furniture table of claim 1, wherein a length of a lower horizontal support beam is adjustable to adjust a distance between the first foot and the second foot.

9. The furniture table of claim 8, wherein the base comprises an opposing bar disposed perpendicular to the lower horizontal support beam.

10. A rotatable tray table comprising:
a table surface;
a first support beam;
a second support beam, wherein a first end of the second support beam is coupled to a first end of the first support beam and is rotatable about a longitudinal axis of the first support beam, and the table surface is rotatable about a second end of the second support beam within a plane parallel to the table surface;
a third support beam, wherein the third support beam is perpendicular to the first support beam and parallel to a plane upon which the second support beam extends;
a first protrusion coupled to the first end of the third support beam and extending away from the third support beam in a first direction;
a second protrusion coupled to a second end of the third support beam and extending away from the third support beam in the first direction; and
a third protrusion and a fourth protrusion coupled to the second end of the first support beam,
wherein the second end of the first support beam is coupleable to either a first end or a second end of the third support beam, and wherein the third protrusion or the fourth protrusion extend from the third support beam in a second direction opposite the first direction.

11. The rotatable tray table of claim 10, wherein a curved portion of the second support beam extends from the first support beam where the second support beam is coupled to the first support beam.

12. The rotatable tray table of claim 10, wherein the first protrusion, the third support beam, and the first support beam are mutually perpendicular.

13. The rotatable tray table of claim 10, wherein the first protrusion and the second protrusion are to stabilize the first support beam in an upright position when disposed under furniture.

14. A portable tray table comprising:
a table surface;
a base consisting of a support beam, a first foot, a second foot, and a third foot,
wherein the first foot and the second foot extend in a first direction and are longitudinally separated, and
wherein the third foot extends in a second direction opposite the first direction;
a first support beam with a first end coupled to the base; and
a second support beam with a first section and a second section, the first section is coupled to a second end of the first support beam, and the second section is coupled to the table surface.

15. The portable tray table of claim 14, comprising a first axis of rotation and a second axis of rotation, the first axis of rotation being along a longitudinal axis of the first support beam and the second axis of rotation being parallel to the first axis of rotation and intersecting the second support beam.

16. The portable tray table of claim 14, wherein a length of the first support beam is adjustable, a length of the second support beam is adjustable, and at least one dimension of the base is adjustable.

17. The portable tray table of claim 16, wherein at least a portion of the base is configured to be disposed underneath furniture.

18. The portable tray table of claim 14, wherein the first section forms a curve and the second section is straight.

* * * * *